US007817955B2

(12) United States Patent
Kojima et al.

(10) Patent No.: US 7,817,955 B2
(45) **Date of Patent: *Oct. 19, 2010**

(54) IMAGE FORMING APPARATUS FOR SECURING GOOD CLEANING PERFORMANCE WITHOUT CLEANING BLADE ABRASION

(75) Inventors: Satoshi Kojima, Numazu (JP); Naohiro Watanabe, Shizuoka-ken (JP); Osamu Uchinokura, Mishima (JP); Tsuneyasu Nagatomo, Numazu (JP)

(73) Assignee: Ricoh Company Limited, Tokyo (JP)

( * ) Notice: Subject to any disclaimer, the term of this patent is extended or adjusted under 35 U.S.C. 154(b) by 294 days.

This patent is subject to a terminal disclaimer.

(21) Appl. No.: 11/857,791

(22) Filed: Sep. 19, 2007

(65) Prior Publication Data

US 2008/0069616 A1 Mar. 20, 2008

(30) Foreign Application Priority Data

Sep. 19, 2006 (JP) ..... 2006-252000

(51) Int. Cl.
*G03G 21/00* (2006.01)
*G03G 9/00* (2006.01)

(52) U.S. Cl. ..... 399/350; 430/108.1; 430/110.1

(58) Field of Classification Search ..... 399/252, 399/350; 430/105, 108.1, 110.1, 110.3, 110.4, 430/137.1

See application file for complete search history.

(56) References Cited

U.S. PATENT DOCUMENTS 5,752,151 A 5/1998 Inoue et al.
6,143,457 A * 11/2000 Carlini et al. ..... 430/110.1
6,360,068 B1 3/2002 Kinoshita et al.
6,416,914 B1 7/2002 Nakamura et al.
6,432,589 B1 8/2002 Uchinokura et al.

(Continued)

FOREIGN PATENT DOCUMENTS

EP 0 957 407 A2 11/1999

(Continued)

OTHER PUBLICATIONS

U.S. Appl. No. 12/203,278, filed Sep. 3, 2008, Yamada, et al.

(Continued)

*Primary Examiner*—Sandra L Brase
(74) *Attorney, Agent, or Firm*—Oblon, Spivak, McClelland, Maier & Neustadt, L.L.P.

(57) ABSTRACT

An image forming apparatus including an image bearing member to bear a latent electrostatic image, a charging member to charge a surface of the image bearing member, an irradiation member to irradiate the image bearing member to write the latent electrostatic image, a development member to develop the latent electrostatic image with a toner to form a visualized image, a transfer device to transfer the visualized image directly or via an intermediate transfer body to a recording medium, a fixing device to fix the transferred image transferred on the recording medium and a cleaning device to remove residual toner remaining on the image bearing member. In the image forming apparatus, the cleaning device includes an elastic member having a blade forming a front end which is in contact with the image bearing member at a pressure of from 2 to 6 MPa and the toner is granulated in an aqueous phase and contains a laminar inorganic mineral having ions between layers at least part of which is modified by an organic ion and an average of a form factor SF-1 of the toner is from 130 to 160.

9 Claims, 4 Drawing Sheets

U.S. PATENT DOCUMENTS

| | | | | |
|---|---|---|---|---|
| 6,432,590 | B1 | 8/2002 | Ueda et al. | |
| 6,479,204 | B1 | 11/2002 | Uchinokura et al. | |
| 6,503,676 | B2 | 1/2003 | Yamashita et al. | |
| 6,641,969 | B2 | 11/2003 | Uchinokura et al. | |
| 6,733,939 | B2 | 5/2004 | Nanya et al. | |
| 6,737,210 | B2 | 5/2004 | Uchinokura et al. | |
| 6,756,175 | B2 | 6/2004 | Emoto et al. | |
| 6,756,176 | B2 * | 6/2004 | Stegamat et al. | 430/137.1 |
| 6,787,280 | B2 | 9/2004 | Yamashita et al. | |
| 6,818,370 | B2 | 11/2004 | Uchinokura et al. | |
| 6,846,604 | B2 | 1/2005 | Emoto et al. | |
| 6,849,369 | B2 | 2/2005 | Yagi et al. | |
| 6,852,462 | B2 | 2/2005 | Emoto et al. | |
| 6,855,468 | B1 | 2/2005 | Yamamoto et al. | |
| 6,916,587 | B2 | 7/2005 | Fushimi et al. | |
| 6,936,390 | B2 | 8/2005 | Nanya et al. | |
| 7,056,635 | B2 | 6/2006 | Tanaka et al. | |
| 7,056,638 | B1 | 6/2006 | Tomita et al. | |
| 7,163,775 | B2 | 1/2007 | Takada et al. | |
| 7,208,256 | B2 | 4/2007 | Tanaka et al. | |
| 7,217,487 | B2 | 5/2007 | Nanya et al. | |
| 7,241,545 | B2 | 7/2007 | Nanya et al. | |
| 7,258,959 | B2 | 8/2007 | Nakayama et al. | |
| 2004/0131961 | A1 | 7/2004 | Watanabe et al. | |
| 2004/0157146 | A1 | 8/2004 | Tomita et al. | |
| 2004/0265721 | A1 | 12/2004 | Matsuoka et al. | |
| 2005/0003289 | A1 | 1/2005 | Fushimi et al. | |
| 2005/0031980 | A1 | 2/2005 | Inoue et al. | |
| 2005/0042534 | A1 | 2/2005 | Tanaka et al. | |
| 2005/0089786 | A1 | 4/2005 | Sugiura et al. | |
| 2005/0089787 | A1 | 4/2005 | Uchinokura et al. | |
| 2005/0164112 | A1 | 7/2005 | Ohki et al. | |
| 2005/0164114 | A1 | 7/2005 | Yagi et al. | |
| 2005/0208408 | A1 | 9/2005 | Uchinokura et al. | |
| 2005/0208411 | A1 | 9/2005 | Nakayama et al. | |
| 2005/0277044 | A1 | 12/2005 | Watanabe et al. | |
| 2005/0277045 | A1 | 12/2005 | Saito et al. | |
| 2006/0029433 | A1 | 2/2006 | Saito et al. | |
| 2006/0046174 | A1 | 3/2006 | Ohki et al. | |
| 2006/0057488 | A1 | 3/2006 | Inoue et al. | |
| 2006/0063081 | A1 | 3/2006 | Nagatomo et al. | |
| 2006/0063089 | A1 | 3/2006 | Tanaka et al. | |
| 2006/0068312 | A1 | 3/2006 | Yamashita et al. | |
| 2006/0099016 | A1 | 5/2006 | Watanabe et al. | |
| 2006/0099529 | A1 | 5/2006 | Tanaka et al. | |
| 2006/0160011 | A1 | 7/2006 | Inoue et al. | |
| 2006/0204883 | A1 | 9/2006 | Nakayama et al. | |
| 2006/0210903 | A1 | 9/2006 | Ohki et al. | |
| 2006/0240349 | A1 | 10/2006 | Watanabe et al. | |
| 2006/0251979 | A1 | 11/2006 | Watanabe et al. | |
| 2007/0031748 | A1 | 2/2007 | Kotsugai et al. | |
| 2007/0031752 | A1 | 2/2007 | Watanabe et al. | |
| 2007/0037085 | A1 | 2/2007 | Ishii et al. | |
| 2007/0042284 | A1 | 2/2007 | Takada et al. | |
| 2007/0054210 | A1 | 3/2007 | Ohki et al. | |
| 2007/0059626 | A1 | 3/2007 | Inoue et al. | |
| 2007/0134581 | A1 | 6/2007 | Uchinokura et al. | |
| 2007/0141506 | A1 | 6/2007 | Inoue et al. | |
| 2007/0218380 | A1 * | 9/2007 | Uchinokura et al. | 430/108.1 |
| 2007/0218382 | A1 * | 9/2007 | Emoto et al. | 430/108.1 |
| 2007/0218385 | A1 * | 9/2007 | Kojima et al. | 430/108.1 |

FOREIGN PATENT DOCUMENTS

| | | | |
|---|---|---|---|
| EP | 1 835 351 | A1 | 9/2007 |
| JP | 2000-267331 | | 9/2000 |
| JP | 2003-323095 | | 11/2003 |
| JP | 2004-117962 | | 4/2004 |
| JP | 2005-049858 | | 2/2005 |
| JP | 2005-215298 | | 8/2005 |
| JP | 2006-195348 | | 7/2006 |
| WO | WO2005-005522 | | 1/2005 |

OTHER PUBLICATIONS

U.S. Appl. No. 12/260,493, filed Oct. 29, 2008, Sawada, et al.
U.S. Appl. No. 11/687,404, filed Mar. 16, 2007, Seshita, et al.
U.S. Appl. No. 11/685,969, filed Mar. 14, 2007, Uchinokura, et al.
U.S. Appl. No. 11/687,372, filed Mar. 16, 2007, Yamada, et al.
U.S. Appl. No. 11/687,328, filed Mar. 16, 2007, Ishii, et al.
U.S. Appl. No. 11/687,060, filed Mar. 16, 2007, Emoto et al.

* cited by examiner $$SF1=\frac{(MXLNG)^2}{AREA}\times\frac{\pi}{4}\times 100$$

IMAGE FORMING APPARATUS FOR SECURING GOOD CLEANING PERFORMANCE WITHOUT CLEANING BLADE ABRASION

BACKGROUND OF THE INVENTION

1. Field of the Invention

The present invention relates to an image forming apparatus using a toner for use in developing an image formed by electrophotography, electrostatic recording, etc., as a developing agent.

2. Discussion of the Background

An image forming apparatus typically includes processes of, for example, uniformly charging the image formation area on the surface of an image bearing member, irradiating the surface of the image bearing member for writing, developing an image on the image bearing member with a frictionally charged toner (developing agent), transferring the image on the image bearing member to a recording medium directly or indirectly via an intermediate transfer body, and fixing the image on the recording medium. Residual toner remaining on the image bearing member which has not been transferred is scraped from the image bearing member in a cleaning process and used in the next image formation process.

As the developing agent, there are a two-component developing agent containing toner and carrier and a single-component developing agent containing magnetic or non-magnetic toner. These toners are typically manufactured by melting, mixing and kneading a resin, a coloring agent, a charge control agent, and a releasing agent, cooling down the mixture and pulverizing and classifying the resultant. However, it is difficult to control the particle size and the form of the toner obtained by this method.

In this situation, studies and development have been made to solve this problem by intentionally controlling the particle size of toner in recent years and methods of toner polymerization, for example, an emulsification polymerization method and a dissolution suspension method, in which granulation is made in an aqueous phase, have become popular.

In addition, the demand for quality images has been increasing in recent years. Reducing and uniforming the particle size of toner are also demanded especially to obtain high definition images in the color image formation. When images are formed with toner having a wide particle size distribution, fine powder toner may scatter and contaminate a development roller, a charging roller, a charging blade, an image bearing member, carrier, etc. Therefore, it is difficult to produce quality images with high reliability by such toner. To the contrary, small toner particles that have a sharp particle size distribution have good development behavior, which leads to great improvement on minute dot reproducibility.

However, toner having a small particles diameter and a sharp particle size distribution has a problem with regard to the cleaning property. Especially, it is difficult to securely remove uniform and small toner particles with blade cleaning. Therefore, various kinds of methods for improving the cleaning property have been proposed by devising toner. One of such methods is to make a spherical form irregular. The form of toner is made to be irregular to reduce powder fluidity of the toner and hold the toner by blade cleaning. Characteristics of toner, for example, transfer quality, transfer efficiency and cleaning property, depend on toner form. Therefore, it is demanded to establish the method of making a toner form irregular.

In the emulsion agglomeration method, toner having an irregular form originating from its primary particles and the agglomeration thereof can be manufactured by agglomerating the primary particles of the emulsion polymerized resin particles. Furthermore, in the dissolution suspension methods and the suspension polymerization methods, in which a toner particle is made from an oil droplet, a method is known in which form irregularizing agents are internally added.

For example, unexamined published Japanese patent application No. (hereinafter referred to as JOP) 2005-049858 describes a method of making toner form irregular in which an inorganic filler, for example, silica, is contained inside toner to secure blade cleaning performance.

However, the blade cleaning achieved thereby is on the macro level and still needs improvement on the minute level.

There are two main indices to indicate the cleaning property. The first is bad cleaning performance A in which a cleaning blade does not hold toner completely and thus some toner remain on the surface of an image bearing member. This results in background fouling. The second is bad cleaning performance B caused by unstable movement of a cleaning blade nip portion. Toner slips through the cleaning blade only at the position where the unstable movement of the cleaning blade occurs in the width direction thereof. This results in fouling by streaks.

It is possible to reduce the bad cleaning performance A by making the toner form irregular, which is described above. However, this is not sufficient to reduce the bad cleaning performance B.

With regard to blade cleaning, various kinds of studies and development have been made, for example, "the friction index $\mu$ at the contact position of a blade and an image bearing member is desired to be low", or "the torque of an image bearing member is desired to be stable with in a certain level". The mechanism of the blade cleaning system is that toner is stopped and held at the nip formed between a blade one after another (this is referred to as dam effect). When there is a gap between an image bearing member and a cleaning blade due to flopping and/or stick slip of the nip portion of the blade, the bad cleaning B is deduced to occur. Namely, the contact state of the nip portion formed while an image bearing member rotates is unstable, the bad cleaning performance B occurs.

In a typical method of making a toner form irregular, aggregated bodies of inorganic filler particles is present on the surface of toner. In the case of the toner for use in the present invention, modified laminar inorganic minerals exist on the surface of toner, which has relatively good cleaning property in comparison with the typical method case. This is considered as follows: Since the toner on which aggregation bodies of inorganic filler particles are present has particle materials on the concave portions formed due to form irregularization, the toner particles are not easily engaged with each other so that a dam may not be formed.

SUMMARY OF THE INVENTION

Because of these reasons, the present inventors recognize that a need exists for an image forming apparatus and a process cartridge which produce quality images with minute dot reproducibility by securing good cleaning performance without cleaning blade abrasion.

Accordingly, an object of the present invention is to provide an image forming apparatus and a process cartridge which produce quality images with minute dot reproducibility by securing good cleaning performance without cleaning blade abrasion. Briefly this object and other objects of the present invention as hereinafter described will become more readily apparent and can be attained, either individually or in combination thereof, by an image forming apparatus including an image bearing member to bear a latent electrostatic image, a charging member to charge a surface of the image bearing member, an irradiation member to irradiate the image bearing member to write the latent electrostatic image, a development member to develop the latent electrostatic image with a toner to form a visualized image, a transfer device to transfer the visualized image directly or via an intermediate transfer body to a recording medium, a fixing device to fix the transferred image transferred on the recording medium, and a cleaning device to remove residual toner remaining on the image bearing member. In addition, the cleaning device includes an elastic member having a blade forming a front end which is in contact with the image bearing member at a pressure of from 2 to 6 MPa and the toner is granulated in an aqueous phase and contains a laminar inorganic mineral having ions between layers at least part of which is modified by an organic ion. Furthermore, the average of a form factor SF-1 of the toner is in the range of from 130 to 160.

It is preferred that, in the image forming apparatus mentioned above, the number of particles of the toner having a form factor SF-1 of from 100 to 115 is not greater than 2% by number.

It is still further preferred that, in the image forming apparatus, the toner is manufactured by dissolving and/or dispersing in an organic solvent a toner composition containing a binder resin, a prepolymer containing a modified polyester-based resin, a compound which elongates or cross-links with the prepolymer, a coloring agent, a releasing agent, and the laminar inorganic mineral having ions between layers part of which is modified by an organic ion, emulsifying and/or dispersing the solution or the liquid dispersion in an aqueous medium to conduct a cross-linking reaction and/or an elongation reaction, and removing the solvent from the resultant liquid dispersion.

It is still further preferred that, in the image forming apparatus mentioned above, the laminar inorganic mineral is contained in the toner composition in an amount of from 0.025 to 5% by weight.

It is still further preferred that, in the image forming apparatus mentioned above, the toner has a volume average particle diameter (Dv) of from 3 to 8 μm and the ratio (Dv/Dn) of the volume average particle diameter (Dv) to the number average particle diameter (Dn) is from 1.00 to 1.30.

It is still further preferred that, in the image forming apparatus mentioned above, the toner contains particles having a particle diameter of not greater than 2 μm in an amount of from 1 to 10% by number.

It is still further preferred that, in the image forming apparatus mentioned above, particulates having a primary average particle diameter of from 50 to 500 nm and a bulk density of not less than 0.3 g/cm$^2$ are externally added to the surface of a mother toner particle of the toner.

As another aspect of the present invention, a process cartridge is provided which includes an image bearing member, and at least one of a charging device, a development device and a cleaning device. The image bearing member and the at least one of a charging device, a development device and a cleaning device are integrated into one unit and the process cartridge is detachably attached to the main body of the image forming apparatus mentioned above.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawing(s) in which like reference characters designate like corresponding parts throughout and wherein.

DETAILED DESCRIPTION OF THE INVENTION

Figure 1:
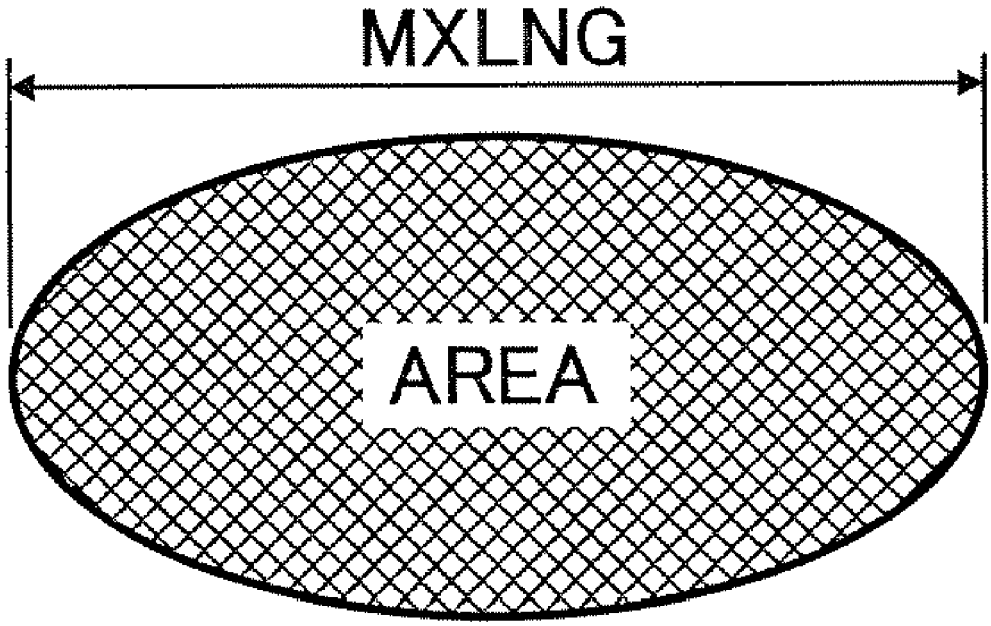
FIG. 1 is a diagram illustrating a toner particle for use in describing the calculation method for SF-1.

Generally, the present invention provides an image forming apparatus which produces quality images with excellent minute dot reproducibility by using a modified laminar inorganic mineral for a toner granulated in an aqueous phase in toner form irregularization in combination with a specific form factor of the toner and a specific area pressure between an image bearing member and an elastic member. It is thus possible to obtain quality images by utilizing the merit of toner granulated in an aqueous medium and securing a good cleaning performance.

It is possible to improve the cleaning performance of the image forming apparatus of the present invention and reduce the abrasion of a cleaning blade therein by using a toner having a laminar inorganic mineral having ions between layers at least part of which is modified by an organic ion and limiting the area pressure between an image bearing member and an elastic member to a range of from 2 to 6 Mpa. In addition, the average of the form factor SF-1 of the toner is in the range of from 130 to 160.

The cleaning process is a process of removing residual toner remaining on the surface of an image bearing member with a cleaning device. A specific example of the cleaning device is a cleaning blade.

When a toner having a spherical form with a small diameter is used, pressing a cleaning blade against an image bearing member is increased to stop toner from slipping through the cleaning blade.

Typically, line pressure is used as the specific index to represent the force of preventing toner from slipping through a cleaning blade. The line pressure is a value (gf/cm) obtained by dividing the total load imparted to a cleaning blade with the length of ridge line of the front end of a cleaning blade which is pressed against an image bearing member.

Specifically, the value is obtained as follows: The front end having a stick form of a cleaning blade is pressed against an image bearing member and a sheet form sensor is inserted at this pressing position. The value is obtained by dividing the output (the load (g) applied to the pressing position) by the sensor with the length (cm) of the pressing position along the image baring member axis.

The sheet form sensor has a great number of electrodes arranged inside in two directions (row and column) perpendicular to each other and is covered with a film resin. In these electrodes, a pressure-resistance material and a charge generating material are arranged in a grid manner. When a pressure is applied to the grid intersection, the resistance varies depending on the load. This resistance change is reflected as the change in current flowing in the row direction and the column direction. The layer load is obtained by this current.

When this line pressure is increased, the cleaning property of a toner having a small spherical form is improved. However, side-effect occurs such that the abrasion of an image bearing member and a cleaning blade is accelerated, and the driving torque of an image bearing member increases.

Also, by this specific value of line pressure, it is not possible to sufficiently evaluate the ability to prevent toner from slipping through a cleaning blade. The reason is: A cleaning blade forms a nip with an image bearing member at the cleaning blade pressed position and contacts the image bearing member by face not by line; As described above, line pressure is a value obtained by dividing the total load applied to a cleaning blade with the length (cm) of the pressing position along the image bearing member axis; and the contact area between an image bearing member and a cleaning blade is not taken into consideration at all.

As another specific value to represent the ability of preventing toner from slipping through a cleaning blade, area pressure can be used which is obtained by dividing the total load applied to a cleaning blade with the contact area between the cleaning blade and an image bearing member. The contact area of a cleaning blade against an image bearing member changes according to the hardness, thickness, free length, form, etc., of a rubber blade and material, form and a supporting method of a cleaning blade. These changes reflect in the area pressure even when the same load is applied to a cleaning blade. When the area pressure is too small, the load applied from the front end of a cleaning blade to an image bearing member tends to be excessively small and toner slips through a blade, resulting in bad cleaning performance. To the contrary, when the area pressure is too large, the load to an image bearing member tends to be excessively large, which leads to acceleration of abrasion of the image bearing member. Thus, suitable area pressure is from 2 to 6 MPa.

Toner that has an excessively small average form factor SF-1 easily causes bad cleaning performance caused by toner slipping through a cleaning device. When the average form factor SF-1 is too large, the degree of irregular forming of toner tends to be too great, which induces bad transfer performance. Foe example, the probability of producing wormhole images increases as the result of bad transfer. The average form factor SF-1 is preferably from 130 to 150.

By using such toner, good cleaning performance can be secured even when a cleaning blade is used as a cleaning device.

When the degree of irregular forming of toner is too great, the behavior of toner is unstable during development, etc., resulting in deterioration of minute dot reproducibility. As described above, the characteristics, for example, transfer quality, transfer efficiency and cleaning property, of toner are affected by toner form. Therefore, to obtain a toner having the characteristics mentioned above, toner form distribution is desired to be optimally designed.

For example, JOP 2005-215298 describes a toner having an average form factor SF-1 of not less than 110 and satisfying the following relationship in the number distribution of SF-1: $2.0 \leqq A/B \leqq 7.0$ (in the relationship, A represents the ratio of the number of toner particles in the range of + or −5 of the form factor SF-1 having a local maximum value to the total number of the toner particles and B represents the ratio of the number of toner particles having a form factor SF-1 of not less than 150 to the total number of the toner particles). However, there is a problem that toner having a small figure for the form factor SF-1 is not considered in the toner described in JOP 2005-215298 and has an impact on the cleaning property.

In addition, JOP 2000-267331 describes a toner having an average form factor SF-1 of from 125 to 140 and satisfying the following relationship: (the number of particles having a form factor SF-1 of not greater than 120)≦20% and (the number of particles having a form factor SF-1 of not less than 150)≦20%. However, by the relationship regulating the small value range in SF-1 (i.e., (the number of particles having a form factor SF-1 of not greater than 120)≦20%), the particles in that range is not sufficiently removed, which has an adverse impact on the cleaning property. That is, fine powder contained in the toner easily contaminates a development device, an image bearing member, an intermediate transfer body, etc.

In the present invention, it is possible to secure good cleaning performance even when a cleaning blade is used as a cleaning device by using a toner having an average of the form factor SF-1 of from 130 to 160 and satisfying the following relationship: (the number of particles having a form factor SF-1 of from 100 to 115)≦2% by number. Form factor FIG. 1 is a diagram illustrating a toner form to describe the form factor SF-1. The form factor SF-1 represents the degree of roundness of a toner particle and is represented by the following relationship:

$$SF\text{-}1=\{(MXLNG)^2/(\mathrm{AREA})\}\times(100\pi/4) \quad (1)$$

In the relationship, MXLNG represents a diameter of the circle circumscribing a two-dimension image of a toner particle obtained, for example, by observing the toner particle with a microscope, and AREA represents the area of the image.

A toner particle that has an SF-1 of 100 has a true sphere form. As the SF-1 increases, the toner form differs away from a true sphere form.

The form factor SF-1 is determined by the following method:

(1) a photograph (SEM image) of a toner particle is taken using a scanning electron microscope (FE-SEM (S-4200), manufactured by Hitachi Ltd.); and (2) images of 300 toner particles are analyzed using an image analyzer (LUZEXAP, manufactured by Nireco Corp.).

SF-1 is preferably determined by using LUZEX mentioned above but there is no specific reason to limit to the devices mentioned above as long as the same analysis can be obtained.

When toner has a form close to a true sphere, the contact between toner particles becomes a point to point contact. Thereby, the adhesion force between toner particles weakens and therefore, the toner has a good fluidity. In addition, the adhesion force between the toner and an image bearing member is also weak and the transfer rate of the toner is high. When the form factor SF-1 is too large, for example, 180, the transfer ratio decreases, which is not preferred.

In addition, the toner for use in the present invention is manufactured by granulation in an aqueous phase. The toner is preferably prepared by dissolving or dispersing in an organic solvent a binder resin, a prepolymer formed of a modified polyester-based resin, a compound which elongates and/or cross-links with the prepolymer, a coloring agent, a releasing agent, and a laminar inorganic mineral (hereinafter referred to as modified laminar inorganic mineral) having ions between layers part of which is modified by an organic ion, and (2) emulsifying and/or dispersing the solution or the liquid dispersion in an aqueous medium to conduct a cross-linking reaction and/or an elongation reaction, and removing the solvent from the resultant liquid dispersion. The solution or the liquid dispersion preferably has a Casson yield value of from 1 to 100 Pa at 25° C.

The toner which can be preferably used in the image forming apparatus of the present invention is prepared by conducting a cross-linking reaction and/or an elongating reaction of liquid of a toner material in an aqueous medium. The liquid of toner material is formed by dispersing at least a polyester prepolymer having a functional group containing a nitrogen atom, a polyester, a compound which elongates or cross-links with the prepolymer, a coloring agent, a releasing agent, and a modified laminar inorganic mineral. Below are the description of the toner composition material and the method of manufacturing the toner.

Polyester

Polyesters are obtained when polyols (PO) and polycarboxylic compounds are subject to polycondensation reaction.

Suitable preferred polyols (PO) include diols (DIO) and polyols (TO) having three or more hydroxyl groups. It is preferable to use diols (DIO) alone or mixtures in which a small amount of a polyol (TO) is added to a diol (DIO).

Specific examples of the diols (DIO) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (PC) include dicarboxylic acids (DIC) and polycarboxylic acids (TC) having three or more carboxyl groups. It is preferable to use dicarboxylic acids (DIC) alone or mixtures in which a small amount of a polycarboxylic acid (TC) is added to a dicarboxylic acid (DIC).

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

As the polycarboxylic acid (PC), anhydrides or lower alkyl esters (e.g., methyl esters, ethyl esters or isopropyl esters) of the polycarboxylic acids mentioned above can be used for the reaction with a polyol (PO).

Suitable mixing ratio (i.e., an equivalence ratio [OH]/[COOH]) of a polyol (PO) to a polycarboxylic acid (PC) ranges from 2/1 to 1/1, preferably from 1.5/1 to 1/1 and more preferably from 1.3/1 to 1.02/1.

Polyols (PO) and polycarboxylic acid (PC) are subjected to polycondensation reaction as follows:

(1) Heat a polyol and a polycarbonic acid to 150 to 280° C. in the presence of a known esterification catalyst such as tetra butoxy titanate and dibutyl tin oxide.

(2) Remove the generated water while decreasing the pressure if necessary to obtain a polyester having a hydroxyl group. The polyester obtained preferably has a hydroxyl value of at least 5 and normally has an acid value of from 1 to 30 and preferably from 5 to 20. When a polyester has an acid value, the polyester can be easily charged with a negative polarity. In addition, a toner including such a polyester has a good affinity with a recording paper and therefore the low temperature fixability of the toner improves when fixing the toner onto the recording paper. However, when the acid value is too large, the charging stability of the toner tends to deteriorate especially to environmental changes.

The weight average molecular weight is from 10,000 to 400,000 and preferably from 20,000 to 200,000. It is not preferred to have too small weight average molecular weight because anti-offset properties deteriorate. It is not also preferred to have too large weight average molecular weight because low temperature fixability deteriorates.

As the prepolymer formed of a modified polyester-based resin, polyester prepolymers having a functional group containing a nitrogen atom are preferred. Preferred specific examples of the polyester prepolymers having a functional group containing a nitrogen atom include a polyester prepolymer (A) having an isocyanate group formed by reaction between the carboxyl group or hydroxyl group placed at the end of the polyester obtained by the polycondensation reaction mentioned above and a polyisocyanate compound (PIC). Compounds that elongate or cross-link with the prepolymer in this case are, for example, amines. Molecular chains are cross-linked and/or elongated by the reaction between the polyester prepolymer (A) having an isocyanate group and an amine and a urea-modified polyester is obtained.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocyantes (e.g., tolylene diisocyanate and diphenylmethane diisocyanate); aromatic aliphatic diisocyanates (e.g., $\alpha, \alpha, \alpha', \alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (PIC) to a polyester having a hydroxyl group varies from 5/1 to 1/1, preferably from 4/1 to 1.2/1 and more preferably from 2.5/1 to 1.5/1. When the [NCO]/[OH] ratio is too large, the low temperature fixability of the toner tends to deteriorate. In contrast, when the ratio is too small, the content of the urea group in the modified polyesters decreases, which may lead to deterioration of the hot-offset resistance of the toner.

The content of the constitutional component of a polyisocyanate (PIC) in the polyester prepolymer (A) having an isocyanate group at its end portion ranges from 0.5 to 40% by weight, preferably from 1 to 30% by weight and more preferably from 2 to 20% by weight. When the content is too low, the hot offset resistance of the toner tends to deteriorate and in addition the heat resistance and low temperature fixability of the toner also tends to deteriorate. In contrast, when the content is too high, the low temperature fixability of the toner easily deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is too small (less than 1 per 1 molecule), the molecular weight of the resultant urea-modified polyester decreases and thereby the hot offset resistance deteriorates.

Specific examples of the amines (B), which are to be reacted with a polyester prepolymer (A), include diamines (B1), polyamines (B2) having three or more amino groups, amino alcohols (B3), amino mercaptans (B4), amino acids (B5), and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine (B1) is mixed with a small amount of a polyamine (B2) are preferable.

The mixing ratio (i.e., a ratio [NCO]/[NHx]) of the content of the prepolymer (A) having an isocyanate group to the amine (B) ranges from 1/2 to 2/1, preferably from 1.5/1 to 1/1.5 and more preferably from 1.2/1 to 1/1.2. When the mixing ratio is too low or too high, the molecular weight of the resultant urea-modified polyester easily decreases, resulting in deterioration of the hot offset resistance of the resultant toner.

The modified polyesters may include a urethane linkage as well as a urea linkage. The molar ratio (urea/urethane) of the urea linkage to the urethane linkage may vary from 100/0 to 10/90, preferably from 80/20 to 20/80 and more preferably from 60/40 to 30/70. When the content of the urea linkage is too low, the hot offset resistance of the resultant toner may deteriorate.

Urea-modified polyesters can be prepared in different ways, including, for example, one-shot methods as follows:

(1) Heat a polyol and a polycarbonic acid to 150 to 280° C. in the presence of a known esterification catalyst such as tetra butoxy titanate and dibutyl tin oxide.

(2) Remove the generated water while decreasing the pressure if necessary to obtain a polyester having a hydroxyl group.

(3) React the polyester with a polyisocyanate (PIC) at temperatures in the range of from 40 to 140° C. to obtain a polyester prepolymer (A) having an isocyanate group.

(4) React the prepolymer (A) with an amine (B) at temperatures in the range of from 0 to 140° C. to obtain a urea-modified polyester.

Usable solvents should be inactive to isocyanates (PIC) and suitable preferred solvents include, but are not limited to, aromatic solvents such as toluene and xylene; ketones such as acetone, methyl ethyl ketone and methyl isobutyl ketone; esters such as acetic ether; amides such as dimethyl formamide and dimethyl acetamide; and ethers such as tetrahydrofuran In the crosslinking reaction and/or elongation reaction of a polyester prepolymer (A) with an amine (B), a reaction inhibitor can be used if desired to control the molecular weight of the resultant urea-modified polyester. Specific examples of such a reaction inhibitor include monoamines (e.g., diethyl amine, dibutyl amine, butyl amine and lauryl amine), and blocked amines (i.e., ketimine compounds) prepared by blocking the monoamines mentioned above.

The weight average molecular weight of the urea-modified polyesters is not less than 10,000, preferably from 20,000 to 10,000,000 and more preferably from 30,000 to 1,000,000. When the weight average molecular weight is too low, the hot offset resistance of the resultant toner tend to deteriorate. The number average molecular weight of the urea-modified polyesters is not particularly limited (i.e., the weight average molecular weight should be primarily controlled so as to be in the range mentioned above) when the unmodified polyester resin mentioned above is used in combination. Namely, controlling of the weight average molecular weight of the modified polyester resins has priority over controlling of the number average molecular weight thereof. However, when a urea-modified polyester is used alone, the number average molecular weight thereof is from 2,000 to 15,000, preferably from 2,000 to 10,000 and more preferably from 2,000 to 8,000. When the number average molecular weight is too large, the low temperature fixability of the resultant toner tends to deteriorate, and in addition the gloss of full color images decreases when the toner is used in a full color image forming apparatus.

By using a combination of a urea-modified polyester with an unmodified polyester, the low temperature fixability of the toner improves and in addition the toner can produce color images having high gloss when the toner is used in a full-color image forming apparatus. Therefore, the combinational use of an unmodified polyester and a urea-modified polyester is preferable to a single use of the urea-modified polyester. As the unmodified polyester, polyester resins modified by a linkage (such as urethane linkage) other than a urea linkage, can also be used as well as unmodified polyester resins.

When a mixture of a modified polyester with a urea-unmodified polyester is used, it is preferred that the modified polyester at least partially mix with the unmodified polyester in terms of the low temperature fixability and hot offset resistance of the resultant toner. Namely, it is preferred that the unmodified polyester has a structure similar to that of the urea-modified polyester. The mixing ratio of an unmodified polyester to a urea-modified polyester varies from 20/80 to 95/5, preferably from 70/30 to 95/5, more preferably from 75/25 to 95/5, and even more preferably from 80/20 to 93/7. When the added amount of urea-modified polyester is too small, the hot offset resistance of the resultant toner tends to deteriorate and, in addition, it is difficult to have a good combination of high temperature preservability and low temperature fixability to the resultant toner.

The binder resin including the unmodified polyester and the modified polyester has a glass transition temperature (Tg) of from 45 to 65° C., and preferably from 45 to 60° C. When the glass transition temperature is too low, the high temperature preservability of the toner tends to deteriorate. In contrast, when the glass transition temperature is too high, the low temperature fixability of the toner easily deteriorates. Since a urea-modified polyester resin tends to exist on the surface of the mother toner particle obtained, the resultant toner tends to show good high temperature preservability in comparison with typical toners containing a polyester resin as a binder resin even when the binder resin has a relatively low glass transition temperature.

Coloring Agent

Suitable coloring agents for use in the toner for use in the present invention include known dyes and pigments.

Specific examples of the coloring agents include carbon black, Nigrosine dyes, black iron oxide, Naphthol Yellow S, HANSA Yellow (10G, 5G and G), Cadmium Yellow, yellow iron oxide, loess, chrome yellow, Titan Yellow, polyazo yellow, Oil Yellow, HANSA Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, LITHOL RUBINE GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, PYRAZOLONE Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination.

The content of the coloring agent in the toner is preferably from 1 to 15% by weight, and more preferably from 3 to 10% by weight, based on the total weight of the toner.

Master batch pigments, which are prepared by combining a coloring agent with a resin, can be used as the coloring agent of the toner composition of the present invention. Specific examples of the resins for use in the master batch pigments or for use in combination with master batch pigments include; styrene polymers and substituted styrene polymers such as polystyrene, poly-p-chlorostyrene and polyvinyltoluene; copolymers of these and a vinyl compound; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, paraffin waxes, etc. These resins can be used alone or in combination.

Charge Control Agent

A charge control agent may be included in the toner for use in the present invention.

Specific examples of the charge control agent include known charge control agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge control agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these, materials that control the polarity of toner to be negative are preferably used.

The content of the charge control agent is determined depending on the species of the binder resin used, whether or not an additive is added and toner manufacturing method (such as dispersion method) used, and is not particularly limited. However, the content of the charge control agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner tends to increase, resulting in deterioration of the fluidity of the toner and a decrease of the image density of toner images.

Release Agent

The toner for use in the image forming apparatus of the present invention includes a release agent. Suitable release agents include waxes having a melting point of from 50 to 120° C. When such a wax is included in the toner, the wax is dispersed in the binder resin and serves as a release agent at a location between a fixing roller and the toner particles. Thereby hot offset resistance can be improved without applying an oil to the fixing roller used.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokerite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes.

Further, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

The charge control agent, and the release agent can be kneaded with a master batch and a binder resin. In addition, the charge control agent, and the release agent can be added to an organic solvent when the toner constituent liquid is prepared.

Modified Laminar Inorganic Mineral

The modified laminar inorganic mineral for use in the toner for use in the present invention preferably has a Casson yield value of from 1 to 100 Pa at 25° C. in a solution or liquid dispersion in which at least a binder resin, a prepolymer formed of a modified polyester-based resin, a compound which elongates or cross-links with the prepolymer, a coloring agent, a releasing agent, and a modified laminar inorganic mineral are dissolved or dispersed in an organic solvent.

When the Casson yield value is too small, it is difficult to obtain a toner having target form. When the Casson yield value is too large, the manufacturing property tends to deteriorate.

The Casson yield value is a viscosity of the oil phase measured at the emulsification in an aqueous medium.

The content of the modified laminar inorganic mineral contained in a toner composition is preferably from 0.025 to 5% by weight. When the content it too small, it is difficult to obtain the target Casson yield value. When the content it too large, the fixing property tends to deteriorate.

The modified laminar inorganic mineral is a laminar inorganic mineral having ions between layers part of which is modified by an organic ion. Specific examples thereof include a laminar inorganic mineral in which at least part of metal cations between layers is substituted with quaternary ammonium ion. For examples, organic modified montmorillonite and organic modified smectite are included.

Method of Measuring Casson Yield Value

Casson yield value can be measured by using a high shear viscosity meter, etc. The conditions are as follows:

Device: AR2000 (manufactured by TA Instruments)
Shear stress: 120 Pa/5 min
Geometry: 40 mm steel plate
Geometry gap: 1 mm
Analysis software: TA DATA ANAYALYSIS (manufactured by TA Instruments)

Manufacturing Method

Next, the method of manufacturing the toner for use in the present invention is described below. Preferred specific methods of manufacturing toner are described here but are not limiting.

1) Prepare liquid of toner material by dispersing in an organic solvent a non-modified polyester, a polyester prepolymer having an isocyanate group, a compound (amine) which elongates or cross-links with the prepolymer, a coloring agent, a releasing agent, and a laminar inorganic mineral having ions between layers part of which is modified by an organic ion;

The organic solvent is preferred to be volatile and have a boiling point lower than 100° since it is easy to get removed after mother toner particles are formed. Specific examples thereof include non-water soluble solvents, for example, aqueous toluene, xylene, benzene, carbon tetrachloride, methylene chloride, 1,2-dichloroethane, 1,1,2-trichloroethane, trichloroethylene, chloroform, monochlorobenzene, methyl acetate and ethyl acetate, methylethyl ketone and methylisobuthyl ketone. These can be used alone or in combination. Especially, aromatic hydrocarbons, for example, toluene and xylene, and halogenated hydrocarbons, for example, methylene chloride, 1,2-dichloroethane, chloroform and carbon tetrachloride, are preferred.

The content of the organic solvent is from 0 to 300 parts by weight, preferably from 0 to 100 parts by weight and more preferably from 25 to 70 parts by weight based on 100 parts by weight of polyester prepolymer.

2) Emulsify the liquid of toner material in an aqueous medium in the presence of a surface active agent and a resin particulate.

Suitable aqueous media for use in the present invention include water, and mixtures of water with a solvent which can be mixed with water. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

The content of the aqueous medium is normally from 50 to 2,000 parts by weight and preferably from 100 to 1,000 parts by weight per 100 parts by weight of the liquid of toner material. When the content of the aqueous medium is too small, the liquid of toner material tends not to sufficiently disperse and thereby toner particles having a desired particle diameter are difficult to obtain. When the content is too large, the manufacturing cost increases.

In addition, to sufficiently disperse the liquid of toner material in an aqueous medium, a dispersing agent, for example, a surface active agent and a resin particulate, is suitably added.

Specific examples of the surface active agents include anionic dispersing agents, for example, alkylbenzene sulfonic acid salts, α-olefin sulfonic acid salts, and phosphoric acid salts; cationic dispersing agents, for example, amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic dispersing agents, for example, fatty acid amide derivatives, polyhydric alcohol derivatives; and ampholytic dispersing agents, for example, alanine, dodecyldi(aminoethyl)glycin, di)octylaminoethyle) glycin, and N-alkyl-N,N-dimethylammonium betaine.

A surface active agent having a fluoroalkyl group greatly contributes to good dispersion with an extremely small amount thereof. Specific examples of the anionic surface active agents having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16) ethylphosphates, etc.

Specific examples of the marketed products of such surface active agents having a fluoroalkyl group include SURFLON® S-111, S-112 and S-113, which are manufactured by Asahi Glass Co., Ltd.; FRORARD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surface active agents having a fluoroalkyl group include primary, secondary and tertiary aliphatic amino acids, aliphatic quaternary ammonium salts (for example, perfluoroalkyl (C6-C10) sulfoneamidepropyltrimethyl ammonium salts), benzalkonium salts, benzetonium chloride, pyridinium salts, and imidazolinium salts. Specific examples of commercially available products of these elements include SURFLON® S-121 (from Asahi Glass Co., Ltd.); FRORARD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Resin particulates are added to stabilize mother toner particles formed in an aqueous medium. It is preferred that the covering ratio of such resin particulates over the surface of mother toner particles is from 10 to 90%. Specific examples of the particulate polymers include particulate polymethyl methacylate having a particle diameter 1 μm or 3 μm, particulate polystyrene having a particle diameter 0.5 μm or 2 μm, particulate styrene-acrylonitrile copolymers having a particle diameter of 1 μm, etc. Specific examples of the marketed particulate polymers include PB-200H (from Kao Corp.), SGP (Soken Chemical & Engineering Co., Ltd.), TECHNOPOLYMER® SB (Sekisui Plastics Co., Ltd.), SPG-3G (Soken Chemical & Engineering Co., Ltd.), MICROPEARL® (Sekisui Fine Chemical Co., Ltd.), etc.

In addition, a water hardly soluble inorganic dispersing agents can be used. Specific examples thereof include tricalcium phosphate, calcium carbonate, titanium oxide, colloidal silica and hydroxyapatite.

Furthermore, it is possible to stably disperse toner components in an aqueous medium using a polymeric protection colloid in combination with the resin particulates and inorganic dispersing agents mentioned above. Specific examples of such protection colloids include polymers and copolymers prepared using monomers, for example, acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers, for example, polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds, for example, methyl cellulose, hydroxyethyl cellulose and hydroxypropyl cellulose, can also be used as the polymeric protective colloid.

There is no particular restriction to the dispersion method. Low speed shearing methods, high speed shearing methods, friction methods, high pressure jet methods, ultrasonic methods, etc., can preferably be used. Among these methods, high speed shearing methods are more preferred because particles having a particle diameter of from 2 to 20 μm can be easily prepared. When a high speed shearing type dispersion machine is used, there is no particular limit to the rotation speed thereof, but the rotation speed is typically from 1,000 to 30,000 rpm, and preferably from 5,000 to 20,000 rpm. The dispersion time is also not particularly limited, but is typically from 0.1 to 5 minutes for a batch production method. The temperature in the dispersion process is typically from 0 to 150° C. (under pressure), and preferably from 40 to 98° C.

3) Conduct a reaction with a polyester prepolymer having an isocyanate group when a liquid emulsion is prepared;

This reaction includes a cross-linking and/or elongation reaction of molecular chains. The reaction time is determined depending on the reactivity, which is determined by the combination of the prepolymers having an active hydrogen such as polyester prepolymer (A) and amines (B). the time is in general from 10 minutes to 40 hours, and preferably from 2 to 24 hours. The reaction temperature is generally from 0 to 150° C., and preferably from 40 to 98° C. In addition, a known catalyst such as dibutyltin laurate and dioctyltin laurate can be optionally used for the reaction.

4) Upon completion of the reaction, remove the organic solvent from the thus prepared emulsion (dispersion) followed by washing and drying to obtain mother toner particles;

To remove the organic solvent, the whole system is gradually heated while agitated under laminar flow conditions. Then the system is strongly agitated in a certain temperature range, followed by solvent removal, to prepare a mother toner having a spindle form.

In this case, when a compound, for example, calcium phosphate, which is soluble in an acid or alkali, is used as a dispersion stabilizer, the compound is dissolved by an acid, for example, hydrochloric acid, followed by washing of the resultant particles with water to remove the salt of calcium phosphate therefrom. In addition, calcium phosphate can be removed using a zymolytic method.

5) Adhere a charge control agent to the mother toner particles obtained as mentioned above in a fixed manner; In addition, externally add an inorganic additive, such as combinations of a particulate silica and a particulate titanium oxide to the mother toner particles to prepare the toner for use in the present invention.

Known methods can be used for the fixed adhesion of a charge control agent and the external addition of inorganic particulates. By using this manufacturing method, the resultant toner can have a relatively small particle diameter and a sharp particle diameter distribution. By providing vigorous agitation during the solvent removing process, the shape of the toner can be controlled to be of a desired form, i.e., a form between a rugby ball and a true sphere form. In addition, the surface characteristics of the toner can also be controlled to produce a surface having a desired roughness, i.e., a surface that is from not too smooth to not too rough.

The toner for use in the present invention preferably has a volume average particle diameter of from 3 to 8 μm and the ratio (Dv/Dn) of the volume average particle diameter (Dv) to the number average particle diameter (Dn) is preferably in the range of from 1.00 to 1.30.

The volume average particle diameter (Dv) is more preferably from 3.0 to 7.0 μm. It is generally said that toner having a small particle diameter is advantageous to obtain a high definition quality image. However, such toner has a disadvantage in terms of transferability and cleaning performance. When a toner that has an excessively small volume average particle diameter is used in a two-component developing agent, the toner tends to adhere to the surface of the carrier and degrade the charging ability of the carrier when repeatedly stirred in a development device. In the case of a single-component developing agent, filming of toner on a development roller tends to occur and the toner also tends to adhere to the members (e.g., blade) for regulating the thickness of toner layer.

When the ratio (Dv/Dn) of the volume average particle diameter (Dv) to the number average particle diameter (Dn) is in the range of from 1.00 to 1.30, a high definition quality image can be obtained. In the case of a two-component developing agent, the fluctuation of the toner particle diameter is reduced even when the developing agent is repeatedly replenished for a long time. In addition, the developability of the toner is excellent and stable during stirring in a development device for a long time. When the ratio (Dv/Dn) is too large, the particle diameter of individual toner particles tends to greatly fluctuate and the behavior of the toner particles is not stable during development. Therefore, the reproducibility of minute dots may deteriorate so that it is difficult to obtain quality images. The ratio (Dv/Dn) is further preferably from 1.00 to 1.20 to obtain excellent images.

Particle Size Distribution

To reproduce minute dots greater than 600 dpi, the volume average particle diameter of toner is preferably from 3 to 8 μm. The ratio (Dv/Dn) is preferably from 1.00 to 1.30. A ratio (Dv/Dn) that is close to 1.00 represents a sharp particle size distribution. Toner having such a small particle diameter and a sharp particle size distribution has a uniform charge amount distribution and contributes to quality images with little background fouling. In addition, such a toner can improve the transfer ratio in the electrostatic transfer system.

Specific example of the measuring device for particle size distribution of toner particles based on Coulter Counter method include COULTER COUNTER TA-II and COULTER MULTI-SIZER II (both are manufactured by Beckman Coulter Inc.). The measuring method is described below.

(1) Add 0.1 to 5 ml of a surface active agent (preferably a salt of an alkyl benzene sulfide) as a dispersing agent to 100 to 150 ml of an electrolytic aqueous solution. The electrolytic aqueous solution is an about 1% NaCl aqueous solution prepared by using primary NaCl (e.g., ISOTON-II®, manufactured by Beckman Coulter Inc.).

(2) Add 2 to 20 mg of a measuring sample to the electrolytic aqueous solution.

(3) The electrolytic aqueous solution in which the measuring sample is suspended is subject to a dispersion treatment for 1 to 3 minutes with a supersonic disperser.

(4) Measure the volume and the number of toner particles or toner with the aperture set to 100 μm for the measuring device mentioned above to calculate the volume distribution and the number distribution.

The volume average particle diameter (Dv) and the number average particle diameter (Dp) can be obtained from the obtained distributions.

The whole range is a particle diameter of from 2.00 to not greater than 40.30 μm and the number of the channels is 13. These channels are: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to not greater than 40.30 μm.

The toner for use in the present invention preferably contains toner particles having a particle diameter of not greater than 2 μm in an amount of from 1 to 10% by number.

The bad phenomena mentioned above caused by the particle diameter are greatly related to the content ratio of fine toner. When the content ratio of toner having a particle diameter of not greater than 2 μm is too large, for example, greater than 10% by number, attachment to a carrier occurs and it is difficult to stabilize chargeability at a high level. To the contrary, when the particles diameter of toner is too great, it is difficult to obtain a high definition quality image and the toner particle diameter tends to greatly fluctuate when the toner in a developing agent is repeatedly replenished. In addition, it is found that the same applies to the case in which the ratio (Dv/Dn) is too great.

Method of Measuring Ratio of Toner Having a Particle Diameter of not Greater than 2 μm The ratio and the circularity of the toner for use in the present invention can be measured by a flow particle image analyzer (FPIA-2000, manufactured by Sysmex Corporation). A specific measuring method is as follows: Add 0.1 to 5 ml of a surface active agent (preferably alkyl benzene sulfonate salt) as a dispersant in 100 to 150 ml of water from which undissolved solid portions in the vessel are removed beforehand; Add about 0.1 to about 0.5 g of the measuring sample; Perform dispersion treatment for the suspension solution in which the sample is dispersed in a supersonic dispersion device for about 1 to about 3 minutes; and measure the form and distribution of the toner by the device mentioned above under the condition that the liquid dispersion density is from 3,000 to 10,000 particles/μl.

The toner for use in the present invention preferably has a substantially sphere form, which can be determined by the following form description.

Figure 2A:
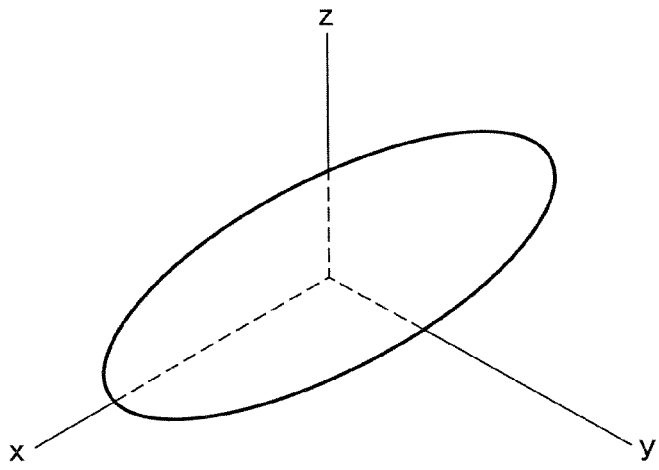
FIGS. 2A-2C are diagrams illustrating the structure of a toner particle having a substantially spherical form.
Figure 2B:
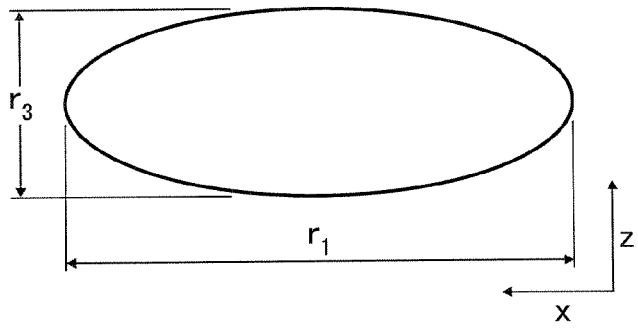
Figure 2C:
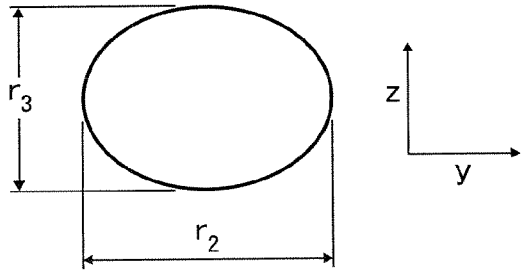

FIG. 2 is a schematic diagram illustrating the form of the toner particle for use in the present invention. When the form of the toner for use in the present invention is determined by its major axis (r1), its minor axis (r2), and its thickness (r3) while these three factors satisfy the following relationship: r1≧r2≧r3, the ratio of r2 to r1 (refer to FIG. 2B) is preferably from 0.5 to less than 1.0 and the ratio of r3 to r2 (refer to FIG. 2C) is preferably from 0.7 to less than 1.0. When the ratio of r2/r1 is too small, the form of the toner particles is away from a sphere form so that the toner tends to be insufficient in dot representation and transfer efficiency, resulting in formation of low quality images. When the ratio of r3/r2 is too small, the toner form is closer to a flat form so that, unlike the case of a toner having a sphere form, a high transfer rate is not obtained.

r1, r2 and r3 can be measured by, for example, the following method: dispersed and attach toner on a smooth measuring surface; enlarge the images of 100 toner particles with a magnification power of 500 by a color laser microscope (VK-8500, manufactured by KEYENCE CORPORATION); and measure the major axis r1 (μm), the minor axis r2 (μm), and the thickness r3 (μm). These are obtained by arithmetical means of the 100 toner particles.

The toner for use in the present invention is preferably a toner obtained by externally adding particulates having an average primary particle diameter of from 50 to 500 nm and a bulk density of not less than 0.3 g/cm$^3$ (hereinafter referred to as particulate) to the surface of a mother toner particle.

By using particulates having an average primary particle diameter of from 50 to 500 nm and a bulk density of not less than 0.3 g/cm$^2$ as an external additive, the cleaning property is good. Especially when a toner having a small particle diameter suitable for producing quality images is used, developability and transferability are improved.

As a fluidity improving agent, for example, silica is used. Such silica normally has a primary particle of from 10 to 30 nm and a bulk density of from 0.1 to 0.2 g/cm$^3$.

In the present invention, since particulates having suitable characteristics are preset on the surface of toner particles, a suitable space is formed between the toner particle and a target body. The particulates have an extremely small contact area with toner particles, an image bearing member and a charging device and uniformly contact therewith. Therefore, the particulates have a large effect in reducing the attachment force and are effective to improve development and transfer efficiency. Further, the particulates do not abrade or damage an image bearing member and tend not to be embedded in a toner particle during cleaning under a high stress (high load and high speed, etc.) between a cleaning blade and an image bearing member. Even when the particulates are slightly embedded in a toner particle, detachment or restoration is possible. Therefore, toner having such a particulate stably maintains characteristics over a long period of time. Furthermore, the particulates suitably detach from toner particles and accumulate at the front end of a cleaning blade so that the particulates can prevent toner slipping through the cleaning blade by the dam effect. These characteristics have function of reducing the share of toner particles receiving and help to reduce the occurrence of filming of toner caused by low rheology components contained in the toner due to a high speed fixing (low energy fixing). In addition, when particulates having an average primary particle diameter of from 50 to 500 μm are used, the cleaning performance is excellent and since the particulate is extremely small, the powder fluidity of toner does not deteriorate. Furthermore, although the detail is not clear, when the surface treated particulate is externally added to toner and contaminate a carrier, the degree of contamination of the developing agent is small.

The average primary particle diameter (hereinafter referred to as the average particle diameter) of the particulate is from 50 to 500 nm and preferably from 100 to 400 nm. When the average primary particle diameter is too small, the particulate is embedded in the concave portion of convexo-concave portions and the function of the particulate may deteriorate. When the average primary particle diameter is too large and the particulate is located between a blade and the surface of an image bearing member, the particulate size is on the same magnitude as the contact area of toner itself so that toner particles to be removed may pass through, resulting in bad cleaning performance.

When the bulk density of the particulate is too small, e.g., 0.3 g/cm$^3$, the particulate contributes to fluidity, however, toner and the particulate tend to scatter and increase the attachment property thereof. Therefore, the toner accumulates at the cleaning portion, which reduces the dam effect.

Specific examples of the inorganic compounds for the particulate for use in the present invention include $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, $MgSO_4$, and $SrTiO_3$. Among these, $SiO_2$, $TiO_2$ and $Al_2O_3$ are preferred. These inorganic compounds can be subject to hydrophobic treatment with a coupling agent, hexamethyldisilazane, dimethyldichlorosilane, octyltrimethoxysilane, etc.

In addition, as organic particulates, thermoplastic resin and thermocuring resins can be used. Specific examples thereof include vinyl-based resin, polyurethane resins, epoxy resins, polyester resins, polyamide resins, polyimide resins, silicon-based resins, phenol resins, melamine resins, urea resins, aniline resins, ionomer resins and polycarbonate resins. These can be used alone or in combination. Among these, vinyl-based resins, polyurethane resins, epoxy resins, polyester resins, and combination thereof are preferred in terms of that aqueous dispersion body of fine spherical resin particles is easily obtained.

Specific examples of the vinyl-based resins include polymers (co) polymerized from a vinyl-based monomer. For example, copolymers of styrene-(meth)acrylate, copolymers of styrene-butadiene, copolymers of (meth)acylic acid-acrylate, copolymers of styrene-acrylonitrile, copolymers of styrene-maleic acid anhydride and copolymers of styrene-(meth)acrylic acid.

The bulk density of the particulate is measured as follows:

Particulates are added little by little without vibration in 100 ml Messzylinder until the particulates amount to 100 ml. The bulk density is measured by the weight difference of the Messzylinder before and after the particulates are added.

Bulk density (g/cm$^3$)=Amount of particulate (g/100 ml)/100

As the method of externally adding the particulate for use in the present invention to the surface of toner, there are a method in which mother toner particles and particulates are mechanically mixed with a known mixer to attach the particulate to the toner, a method in which mother toner particles and particulates are uniformly dispersed in liquid phase by using a surface active agent and the resultant is dried after attachment treatment, etc.

The image forming apparatus of the present invention performs the latent electrostatic image formation process (charging process and irradiation process), the development process, the fixing process, and the cleaning process with the optional processes, for example, the discharging process, the recycling process and the control process.

Figure 5:
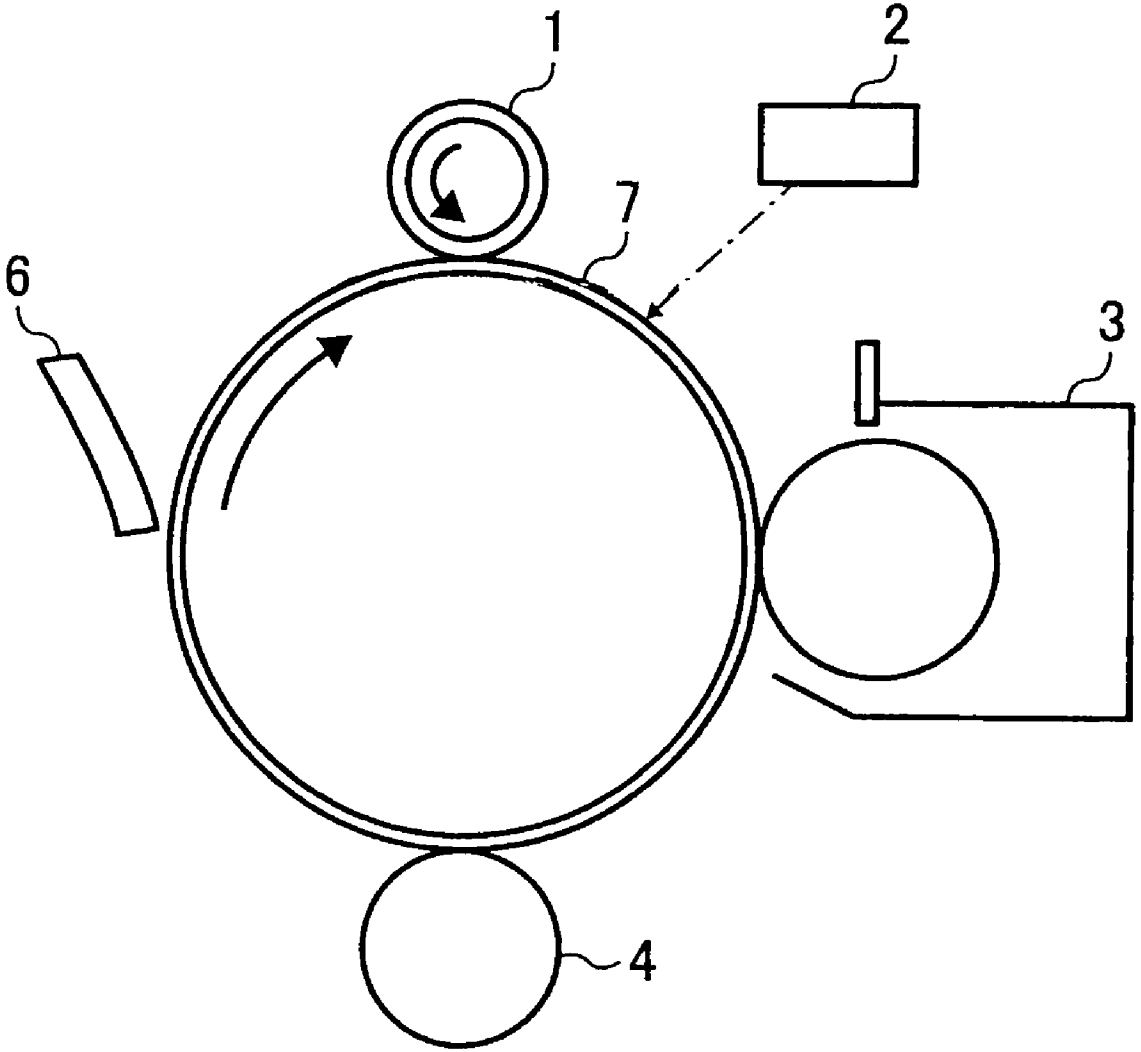
FIG. 5 is a schematic illustration of an image forming apparatus.

FIG. 5 is a schematic illustration of an image forming apparatus and the reference numerals stand for the following: 1—a charging member; 2—an irradiation member; 3—a development member; 4—a transfer device; 6—a cleaning device and 7—an image bearing member.

The latent electrostatic image formation process is a process of forming a latent electrostatic image on an image bearing member. Any known material, form, structure, size, etc. can be suitably selected for the image bearing member. Specific examples of the material include inorganic materials, for example, amorphous silicone and selenium, and organic materials, for example, polysilane and phthalpolymethine. Among these, amorphous silicone is preferred in terms of life length. In addition, the form is preferably a drum. Latent electrostatic images can be formed with a latent electrostatic image forming device by imagewise irradiation after the surface of an image bearing member is uniformly charged. The latent electrostatic image forming device preferably has a charging device to uniformly charge the surface of an image bearing member and an irradiating device to irradiate the surface of an image bearing member.

Charging can be performed to apply a voltage to the surface of an image bearing member with a charging device. The charging device can be suitably selected according to purpose. A known contact type charging device having an electroconductive or semi-conductive roll, brush, film, blade, etc. and a known non-contact type charging device using corona discharging, for example, corotron and scorotron, can be used.

Irradiation can be performed by irradiating the surface of an image bearing member with an irradiating device. Such an irradiating device can be suitably selected according to purpose. Various kinds of irradiating devices, for example, a photocopying optical system, a rod lens array system, a laser optical system, and liquid crystal system, can be used. It is possible to adopt a rear irradiation system in which irradiation is performed from the rear side of an image bearing member.

The development system is a process to form a visualized image by developing a latent electrostatic image with the toner for use in the present invention. The visualized image is formed by a developing device. Such a developing device can be selected among any known developing device, accommodates toner for use in the present invention and preferably has a development unit which can impart the toner to a latent electrostatic image in a contact or non-contact manner. The development unit can be a dry development system or a wet development system. Also, both a single color development unit and a multi-color development unit are usable. Specifically, a stirrer to frictionally charge a developing agent, and a developing unit having a rotationable magnet roller can be used. A developing agent accommodated in a development unit is a developing agent using the toner for use in the present invention. Both a single component developing agent and a two-component developing agent are suitably used.

In a development unit containing a two development developing agent, toner and carrier are mixed and stirred. The toner is frictionally charged and held on the surface of a rotating magnet roller in a filament state to form a magnet brush. The magnet roller is located near an image bearing member. Part of the toner forming the magnet brush formed on the surface of the magnet roller moves to the surface of the image bearing member by electric suction force. Consequently, a latent electrostatic image is developed with the toner and an image visualized by the toner is formed on the surface of the image bearing member.

The transfer process is a process to transfer a visualized image to a recording medium directly or via an intermediate transfer body and can be performed by charging an image bearing member by a transfer device. Such a transfer device preferably has a primary transfer device which transfers a visualized image to an intermediate transfer body to form a complex transfer image and a secondary transfer device which transfers the complex transfer image to a recording medium. The intermediate transfer body can be suitably selected among known transfer bodies. For example, a transfer belt can be used.

The transfer device preferably has a transfer unit that charges and detaches a visualized image formed on an image bearing member to the recording medium. Such a transfer devices can be used singly or in combination. Specific examples of such a transfer device include a corona transfer device based on corona charging, a transfer belt, a transfer roller, a pressure transfer roller and an adhesive transfer device. Any known recoding medium can be used including recording paper.

The fixing process is a process to fix the visualized image on the recording medium by a fixing device. Fixing can be performed each time a color toner image is transferred to a recording medium or at one time when each color toner is accumulated. The fixing device can be suitably selected according to purpose. Any known heat and pressure device can be used. As the heat and pressure device, a combination of a heat roller and a pressure roller and a combination of a heat roller, a pressure roller and an endless belt are used. Heating at a heat and pressure device is preferably from 80 to 200° C. Depending on purposes, such a heat and pressure device can be used in combination with a fixing device or any known optical fixing device can be used instead.

The discharging process is a process to discharge an image bearing member by applying a discharging bias to the image bearing member and can be performed with a discharging device. Any known discharging device can be used and for example, a discharging lamp can be used.

The cleaning process is a process to remove residual toner remaining on an image bearing member and can be performed by a cleaning device. The cleaning device is an elastic member having a blade form with its front in contact with an image bearing member. A cleaning device that has an area pressure of from 2 to 6 Mpa at the contact portion between the image bearing member mentioned above and the elastic member mentioned above.

The recycling process is a process to recycle toner removed by a development device in the cleaning process and can be performed with a recycling device. The recycling device can be suitably selected according to purpose and any known device can be used.

The control process is a process to control each process and can be performed by a control device. Such a control device can be suitably selected according to purpose and a device such as a sequencer or a computer can be used.

The process cartridge of the present invention is for use in and detachably attached to the image forming apparatus of the present invention and integrally includes an image bearing member and at least one device selected from the group of a charging device, a development device and a cleaning device in one unit.

As described above, in a typical method of making a toner form irregular, aggregated bodies of inorganic filler particles is present on the surface of toner. In the case of the toner for use in the present invention, modified laminar inorganic minerals exist on the surface of toner, which has relatively good cleaning property in comparison with the typical method case. This is considered as follows: Since the toner on which aggregation bodies of inorganic filler particles are present has particle materials on the concave portions formed due to form irregularization, the toner particles are not easily engaged with each other so that a dam may not be formed. By contrast, the toner for use in the present invention has a modified laminar mineral in the corresponding concave portion and thus the toner particles are easily engaged with each other so that a dam is formed. This is deduced to be a cause for an effect of reducing unstable movement of a cleaning blade. Thus, the cleaning performance against bad cleaning B is thought to be secured.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is described in detail with reference to Examples but not limited thereto.

Example 1

Synthesis of Non-Modified Polyester Resin

The following components are contained in a reaction container equipped with a condenser, stirrer and a nitrogen introducing tube to conduct a reaction at 230° C. under normal pressure for 8 hours followed by another reaction with a reduced pressure of 10 to 15 mmHg for 5 hours:

| | |
|---|---|
| Adduct of bisphenol A with 2 mol of ethylene oxide | 229 parts |
| Adduct of bisphenol A with 3 mol of propylene oxide | 529 parts |
| Terephtahlic acid | 208 parts |
| Adipic acid | 46 parts |
| Dibutyl tin oxide | 2 parts |

44 parts of trimellitic anhydride is added in the container to conduct a reaction at 180° C. under normal pressure for 2 hours and obtain non-modified polyester resin 1.

The number average molecular weight of the polyester 1 is 2,500, the weight average molecular weight is 6,700, the glass transition temperature is 43° C. and the acid value is 25 mg KOH/g.

Method of Manufacturing Master Batch 1,200 parts of water, 540 parts of carbon black (Printex 35 from Degussa AG) which has a dibutyl phthalate (DBP) oil absorption of 42 ml/100 mg and has a PH of 9.5, and 1,200 parts of the non-modified polyester resin are added and mixed by a HENSCHEL MIXER (manufactured by Mitsui Mining Company, Limited). This mixture is kneaded for 30 minutes at 150° C. using a two-roll mill followed by rolling and cooling. Thereafter, the kneaded mixture is pulverized by a pulverizer (manufactured by Hosokawa Micron Group) to obtain Master batch 1.

Manufacturing of Liquid Dispersion of Wax

The following is placed and mixed in a reaction container equipped with a stirrer and a thermometer:

| | |
|---|---|
| Non-modified polyester 1 | 378 parts |
| Carnauba wax | 110 parts |
| Metal complex of salicylic acid (CCA) (E-84 from Orient Chemical Industries Co., Ltd.) | 22 parts |
| Ethyl acetate | 947 parts |

The mixture is agitated, heated to 80° C., and kept at 80° C. for 5 hours and then cooled down to 30° C. in 1 hour. Then, 500 parts of Master batch 1 and 500 parts of ethyl acetate are added to the reaction container and mixed for 1 hour to obtain Liquid material 1.

Then, 1,324 parts of Liquid material 1 are transferred to a container and dispersed using a bead mill (ULTRAVISCOMILL from AIMEX) under the following conditions to disperse carnauba wax to obtain Liquid Dispersion 1 of wax:

Liquid feeding speed: 1 kg/hr

Disc rotation speed: 6 m/sec

Diameter of zirconia beads: 0.5 mm

Filling factor: 80% by volume

Repeat number of dispersion treatment: 3 times.

Manufacturing of Liquid Dispersion of Toner Material

Then, 1,324 parts of a 65% ethyl acetate solution of Non-modified polyester resin 1 are added thereto, and the mixture is dispersed by the bead mill (ULTRAVISCOMILL) under the conditions mentioned above except that the repeat number of the dispersion treatment is changed to 1 time. To 200 parts of the resultant liquid dispersion, 1.7 parts of laminar inorganic mineral montmorillonite (CLAYTONE APA, manufactured by Southern Clay Inc.) at least part of which is modified by quaternary ammonium salt having a benzyl group is added and the resultant is stirred for 30 minutes by using T.K. HOMODISPER (manufactured by Primix Corporation) to obtain Liquid dispersion (1) of toner material.

The viscosity of Liquid dispersion 1 of the toner material obtained is measured as follows:

Impart a shearing force to the Liquid dispersion of the toner material at the shearing speed of 30,000 $s^{-1}$ seconds for 30 seconds at 25° C. using a parallel plate type rheometer (AR2000, manufactured by TA Instruments, Japan) having a parallel plate having a diameter of 20 mm with a gap set to 30 μm; and then Measure the viscosity (Viscosity A) of the Liquid dispersion when the shearing speed is changed from 0 $s^{-1}$ to 70 $s^{-1}$ in 20 seconds.

In addition, the viscosity (Viscosity B) of the Liquid dispersion is measured using a parallel plate type rheometer (AR2000, manufactured by TA Instruments, Japan) at the shearing speed of 30,000 $s^{-1}$ for 30 seconds at 25°

Synthesis of Intermediate Polyester Resin

The following components are contained in a container equipped with a condenser, a stirrer and a nitrogen introducing tube to conduct a reaction at 230° C. at normal pressure for 8 hours followed by another reaction for 5 hours with a reduced pressure of 10 to 15 mmHg to obtain Intermediate polyester resin:

| | |
|---|---|
| Adduct of bisphenol A with 2 mole of ethylene oxide | 682 parts |
| Adduct of bisphenol A with 2 mole of propylene oxide | 81 parts |
| Terephthalic acid | 283 parts |
| Trimellitic anhydrate | 22 parts |
| Dibutyl tin oxide | 2 parts |

Intermediate polyester resin has a number average molecular weight of 2,100, a weight average molecular weight of 9,500, a glass transition temperature of 55° C., an acid value of 0.5 mgKOH/g and a hydroxyl value of 51 mgKOH/g.

Synthesis of Prepolymer

Next, the following components are contained in a container equipped with a condenser, a stirrer and a nitrogen introducing tube to conduct a reaction at 100° C. for 5 hours to obtain Prepolymer 1:

| | |
|---|---|
| Intermediate polyester resin | 410 parts |
| Isophorone diisocyanate | 89 parts |
| Ethyl acetate | 500 parts |

The content of isolated isocyanate of Prepolymer 1 is 1.53% by weight.

Preparation of Oil Phase Mixture Liquid 170 parts of isophorone diamine and 75 parts of methylethylketone are placed in a reaction container equipped with a stirrer and a thermometer for reaction for 5 hours at 50° C.

to synthesize a ketimine compound. The amine value of the obtained ketimine compound is 418 mgKOH/mg.

749 parts of the Liquid dispersion 1 of the toner material, 115 parts of Prepolymer 1 and 2.9 parts of the ketimine compound are placed in the reaction container and mixed with a TK HOMOMIXER (manufactured by Primix Corporation) at 5,000 rpm for 1 minute to obtain Oil phase mixture liquid 1.

Polymerization of Liquid Dispersion of Resin Particulate

The following components are placed in a container equipped with a stirrer and a thermometer and agitated for 15 minutes at a revolution of 400 rpm.

| | |
|---|---|
| Water | 683 parts |
| Reactive emulsifier (sodium salt of sulfate of an adduct of methacrylic acid with ethyleneoxide (EREMINOR RS-30, manufactured by Sanyo Chemical Industries Ltd.) | 11 parts |
| Styrene | 83 parts |
| Methacrylic acid | 83 parts |
| Butylacrylate | 110 parts |
| Ammonium persulfate | 1 part |

As a result, an emulsion is obtained. Thereafter, the emulsion is heated to 75° C. to conduct a reaction for 5 hours. Then, 30 parts of 1% by weight of aqueous solution of ammonium persulfate are added to the emulsion and the mixture is further aged for 5 hours at 75° C. Resultantly, liquid dispersion of resin particulate is prepared.

Preparation of Emulsified Slurry 83 parts of the liquid dispersion of particulate are mixed and stirred with 990 parts of water, 37 parts of 48.5% by weight aqueous solution of sodium dodecyldiphenylether disulfonate (EREMINOR MON-7, manufactured by Sanyo Chemical Industries, Ltd.), 135 parts of 1% by weight of aqueous solution of polymer dispersing agent: carboxymethyl cellulose sodium (CELLOGEN BS-H-3, manufactured by Dai-ichi Kogyo Seiyaku Kogyo Co., Ltd.) and 90 parts of ethyl acetate to obtain an aqueous medium.

867 parts of Oil phase mixture liquid 1 is added to and mixed with 1,200 parts of the aqueous medium using a TK HOMOMIXER at a rotation number of 13,000 rpm for 20 minutes to prepare a liquid dispersion (Emulsified slurry 1).

Next, Emulsified slurry 1 is placed in an reaction container equipped with a stirrer and a thermometer to remove the solvent at 30° C. for 8 hours and aged at 45° C. for 4 hours to obtain Dispersed slurry 1.

After 100 parts of the Dispersed slurry 1 is filtered with a reduced pressure, 100 parts of deionized water is added to the filtered cake. The resultant is mixed by a TK HOMOMIXER at 12,000 rpm for 10 minutes followed by filtration.

10% by weight of hydrochloric acid is added to the obtained filtered cake to adjust pH of the system to be 2.8. The resultant is mixed by a TK HOMOMIXER at 12,000 rpm for 10 minutes followed by filtration.

Furthermore, 300 parts of deionized water is added to the obtained filtered cake. The resultant is mixed by a TK HOMOMIXER at 12,000 rpm for 10 minutes followed by filtration and this operation is repeated again to obtain a final filtrated cake.

Filtered cake 1 is dried for 48 hours at 45° C. using a circulating drier. The dried cake is sieved using a screen having a mesh size of 75 μm. 100 parts of the obtained mother toner particles, 1.0 part of hydrophobic silica and 0.5 parts of hydrophobized titan oxide are added and mixed by a HENSCHEL MIXER (manufactured by Mitsui Mining Company, Limited) to prepare a toner.

The volume average particle diameter (Dv) and the number average particle diameter (Dn) of the obtained toner are measured by using a size measuring device (Multisizer III, manufactured by Beckman Coulter Inc.) with an aperture of 100 μm and analyzed using an analysis software (Beckman Coulter Multisizer 3 Version 3.51). Specifically, 0.5 ml of 10% by weight of a surface active agent (alkylbenzene sulfonate: NEOGEN SC-A, manufactured by Daiichi Kogyo Co., Ltd.) and 0.5 g of each toner are added to 100 ml glass beaker and stirred by a micro medicine spoon. 80 ml of deionized water is added thereto. The obtained liquid dispersion is subject to dispersion treatment for 10 minutes by a supersonic wave dispersing device (W-113MK-II, manufactured by Honda Electronics). The liquid dispersion is measured by the Multisizer III mentioned above using ISOTONE III (manufactured by Beckman Coulter Inc.) as a measuring solution. The toner sample liquid dispersion is dropped such that the density indicated by the measuring device is from 6 to 10%. In this measuring method, in terms of the measuring reproducibility, it is desired that the density is from 6 to 10%. In this range, the particle diameter is free from error.

The average of SF-1 of the obtained toner and the content ratio of toner having an SF-1 of from 110 to 115 are shown in Table 1.

In addition, using the obtained toner, the amount (g) of toner slipping through a cleaning blade is measured as follows to evaluate the cleaning property. In the 6 of the following cleaning property evaluation, the area pressure at the contact portion between an image bearing member and a cleaning blade is set to be 2.3 Mpa and the evaluation is made. The results are shown in Table 1.

Evaluation on Cleaning Property

Figure 3:
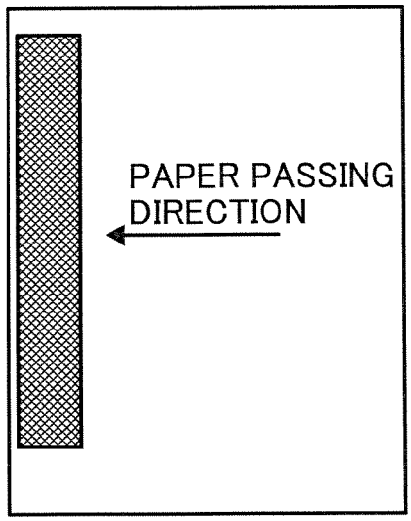
FIG. 3 is a chart for use in image evaluation in Examples described later.

1. Leave all the toner and the devices for use in evaluation in an environment room of 25° C. and 50% humidity for one day;
2. Remove toner from marketed product PCU for Imagio neo C600 to leave only carrier in the development device;
3. Add 28 g of black toner serving as sample in the development device containing only the carrier to prepare 400 g of a developing agent having a toner density of 7%;
4. Attach the development device to the main body of Imagio neo C600 and rotate the development device at a linear speed of the development sleeve of 300 mm/s in an idling manner for 5 minutes;
5. Rotate the development sleeve and the image bearing member at 300 mm/s and adjust the charging voltage and the development bias such that the toner on the image bearing member is from 0.595 to 0.605 mg/cm$^2$;
6. Use only one cleaning blade built in a marketed product PCU of Imagio neo C600 and the cleaning blade has an elasticity of 70%, a thickness of 2 mm and a contact angle with the image bearing member of 20° C. in a counter manner;
7. Under the development conditions, the transfer current is adjusted such that the transfer rate is from 94 to 98%;
8. Attach a fiber tape before the charging roller to collect toner (that has slipped through the cleaning blade) after the cleaning process;
9. Using the set value, output 100 sheets having a chart of a band having 4 cm along the paper passing direction and 25 cm along the width of the paper passing direction as illustrated in FIG. 3; and 10. Measure the amount of toner attached to the tape set in the 8 and evaluate the amount of toner slipping through the cleaning blade.

When the amount of the toner slipping through the cleaning blade is less than 0.25 g, the cleaning performance is evaluated as good.

Example 2

Toner is prepared in the same manner as in Example 1 except that the addition amount of the modified laminar inorganic mineral (CLAYTONE APA, manufactured by Southern Clay Inc.) is changed from 1.7 parts to 1.3 parts. In the 6 of the Evaluation on Cleaning Property, the area pressure between the image bearing member and the cleaning blade is set to be 4.2 Mpa and the evaluation is made. The results are shown in Table 1.

Example 3

Toner is prepared in the same manner as in Example 1 except that the addition amount of the modified laminar inorganic mineral (CLAYTONE APA, manufactured by Southern Clay Inc.) is changed from 1.7 parts to 1.0 part. In the 6 of the Evaluation on Cleaning Property, the area pressure at the contact portion between the image bearing member and the cleaning blade is set to be 5.5 Mpa and the evaluation is made. The results are shown in Table 1.

Comparative Examples 1 to 3

As Comparative Examples 1 to 3, using the toner manufactured in Examples 1 to 3, the area pressure at the contact portion between the image bearing member and the cleaning blade is changed as in the area pressure described in Table 1 and the evaluation is made. The results are shown in Table 1.

Comparative Examples 4 and 5

Toners of Comparative Examples 4 and 5 are prepared in the same manner as in Example 1 except that the modified laminar inorganic mineral (CLAYTONE APA, manufactured by Southern Clay Inc.) is changed to ORGANO SILLICA SOL (MEK-ST-UP, solid portion: 20%, average primary particle diameter: 15 nm, manufactured by Nissan Chemical Industries, Ltd.) and the addition amount thereof is changed to 20 parts. The area pressure at the contact portion between the image bearing member and the cleaning blade is changed as in the area pressure described in Table 1 and the evaluation is made. The results are shown in Table 1.

Comparative Examples 6 and 7

Toner of Comparative Examples 6 and 7 is prepared in the same manner as in Comparative Examples 4 and 5 except that the addition amount of ORGANO SILLICA SOL (MEK-ST-UP, solid portion: 20%, average primary particle diameter: 15 nm, manufactured by Nissan Chemical Industries, Ltd.) is changed from 20 parts to 15 parts. The area pressure at the contact portion between the image bearing member and the cleaning blade is changed as in the area pressure described in Table 1 and the evaluation is made. The results are shown in Table 1.

Comparative Examples 8 and 9

Toner of Comparative Examples 8 and 9 is prepared in the same manner as in Comparative Examples 4 and 5 except that the addition amount of ORGANO SILLICA SOL (MEK-ST-UP, solid portion: 20%, average primary particle diameter: 15 nm, manufactured by Nissan Chemical Industries, Ltd.) is changed from 20 parts to 10 parts. The area pressure at the contact portion between the image bearing member and the cleaning blade is changed as in the area pressure described in Table 1 and the evaluation is made. The results are shown in Table 1.

Figure 4:
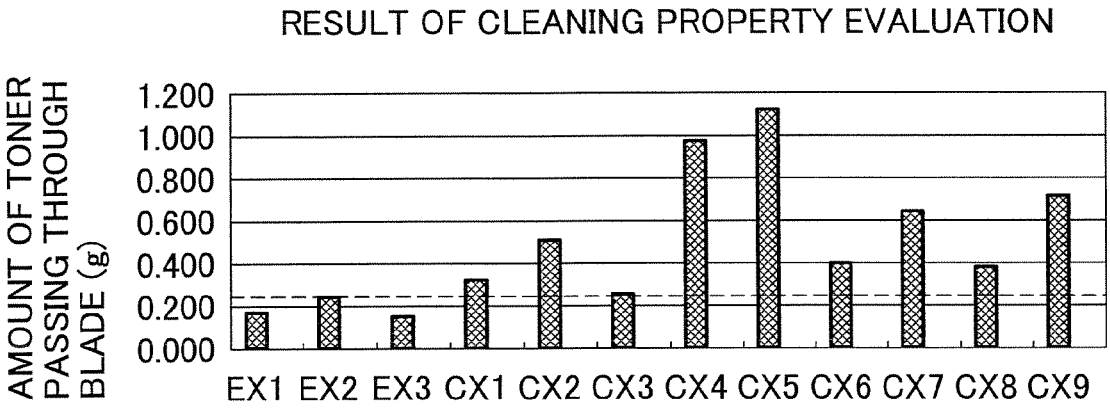
FIG. 4 is a graph illustrating the result of the evaluation on the cleaning performance of Examples described later.

The relationship between each toner and the amount (g) of toner that has slipped through the cleaning blade is illustrated in FIG. 4 using of Examples 1 to 3 and Comparative Examples 1 to 9. X axis represents each toner and Y axis represents the amount of the toner that has slipped through the cleaning blade.

Example 4

Toner is prepared in the same manner as in Example 1 except that the addition amount of the modified laminar inorganic mineral (CLAYTONE APA, manufactured by Southern Clay Inc.) is changed from 1.7 parts to 1.3 parts. In the 6 of the Evaluation on Cleaning Property, the area pressure between the image bearing member and the cleaning blade is set to be 2.3 Mpa and the evaluation is made. The results are shown in Table 1.

Example 5

Toner is prepared in the same manner as in Example 1 except that the addition amount of the modified laminar inorganic mineral (CLAYTONE APA, manufactured by Southern Clay Inc.) is changed from 1.7 parts to 1.0 part. In the 6 of the Evaluation on Cleaning Property, the area pressure between the image bearing member and the cleaning blade is set to be 2.3 Mpa and the evaluation is made. The results are shown in Table 1.

Example 6

Toner is prepared in the same manner as in Example 1 except that the addition amount of the modified laminar inorganic mineral (CLAYTONE APA, manufactured by Southern Clay Inc.) is changed from 1.7 parts to 0.2 parts. In the 6 of the Evaluation on Cleaning Property, the area pressure between the image bearing member and the cleaning blade is set to be 2.3 Mpa and the evaluation is made. The results are shown in Table 1.

Example 7

Toner is prepared in the same manner as in Example 1 except that the addition amount of the modified laminar inorganic mineral (CLAYTONE APA, manufactured by Southern Clay Inc.) is changed from 1.7 parts to 0.05 parts. In the 6 of the Evaluation on Cleaning Property, the area pressure between the image bearing member and the cleaning blade is set to be 2.3 Mpa and the evaluation is made. The results are shown in Table 1.

Example 8

Toner is prepared in the same manner as in Example 1. In the 6 of the Evaluation on Cleaning Property, the area pressure between the image bearing member and the cleaning blade is set to be 5.5 Mpa and the evaluation is made. The results are shown in Table 1.

Example 9

Toner is prepared in the same manner as in Example 1 except that the addition amount of the modified laminar inorganic mineral (CLAYTONE APA, manufactured by Southern Clay Inc.) is changed from 1.7 parts to 1.3 parts. In the 6 of the Evaluation on Cleaning Property, the area pressure between the image bearing member and the cleaning blade is set to be 5.5 Mpa and the evaluation is made. The results are shown in Table 1.

Example 10

Toner is prepared in the same manner as in Example 1 except that the addition amount of the modified laminar inorganic mineral (CLAYTONE APA, manufactured by Southern Clay Inc.) is changed from 1.7 parts to 0.2 parts. In the 6 of the Evaluation on Cleaning Property, the area pressure between the image bearing member and the cleaning blade is set to be 5.5 Mpa and the evaluation is made. The results are shown in Table 1.

Example 11

Toner is prepared in the same manner as in Example 1 except that the addition amount of the modified laminar inorganic mineral (CLAYTONE APA, manufactured by Southern Clay Inc.) is changed from 1.7 parts to 0.05 parts. In the 6 of the Evaluation on Cleaning Property, the area pressure between the image bearing member and the cleaning blade is set to be 5.5 Mpa and the evaluation is made. The results are shown in Table 1.

Example 12

Toner is prepared in the same manner as in Example 1 except that the addition amount of the modified laminar inorganic mineral (CLAYTONE APA, manufactured by Southern Clay Inc.) is changed from 1.7 parts to 0.05 parts. In the 6 of the Evaluation on Cleaning Property, the area pressure between the image bearing member and the cleaning blade is set to be 3.3 Mpa and the evaluation is made. The results are shown in Table 1.

Example 13

Toner is prepared in the same manner as in Example 1 except that the addition amount of the modified laminar inorganic mineral (CLAYTONE APA, manufactured by Southern Clay Inc.) is changed from 1.7 parts to 0.05 parts. In the 6 of the Evaluation on Cleaning Property, the area pressure between the image bearing member and the cleaning blade is set to be 4.2 Mpa and the evaluation is made. The results are shown in Table 1.

Example 14

Toner is prepared in the same manner as in Example 1. In the 6 of the Evaluation on Cleaning Property, the area pressure between the image bearing member and the cleaning blade is set to be 3.3 Mpa and the evaluation is made. The results are shown in Table 1.

Example 15

Toner is prepared in the same manner as in Example 1. In the 6 of the Evaluation on Cleaning Property, the area pressure between the image bearing member and the cleaning blade is set to be 4.2 Mpa and the evaluation is made. The results are shown in Table 1.

Comparative Examples 10 to 12

As Comparative Examples 10 to 12, using the toner manufactured in Examples 5 to 7, the area pressure at the contact portion between the image bearing member and the cleaning blade is changed to 1.5 MPa and the evaluation is made. The results are shown in Table 1.

Comparative Examples 13 to 16

As Comparative Examples 13 to 16, using the toner manufactured in Examples 1, 2, 3 and 6, the area pressure at the contact portion between the image bearing member and the cleaning blade is changed to 6.5 MPa and the evaluation is made. The results are shown in Table 1.

Comparative Examples 17 to 20

Toners of Comparative Examples 17 to 20 are manufactured in the same manner as in Example 1 except that the addition amount of the modified laminar inorganic mineral (CLAYTONE APA, manufactured by Southern Clay Inc.) is changed from 1.7 parts to 0.02 parts. In the 6 of the Evaluation on Cleaning Property, the area pressure between the image bearing member and the cleaning blade is set to be 2.3, 3.3, 4.2 and 5.5 Mpa and the evaluation is made. The results are shown in Table 1.

Comparative Examples 21 to 24

Toners of Comparative Examples 21 to 24 are manufactured in the same manner as in Example 1 except that the addition amount of the modified laminar inorganic mineral (CLAYTONE APA, manufactured by Southern Clay Inc.) is changed from 1.7 parts to 2 parts. In the 6 of the Evaluation on Cleaning Property, the area pressure between the image bearing member and the cleaning blade is set to be 2.3, 3.3, 4.2 and 5.5 Mpa and the evaluation is made. The results are shown in Table 1.

Comparative Examples 25 and 26

Toners of Comparative Examples 25 and 26 are prepared in the same manner as in Example 1 except that the modified laminar inorganic mineral (CLAYTONE APA, manufactured by Southern Clay Inc.) is changed to ORGANO SILLICA SOL (MEK-ST-UP, solid portion: 20%, average primary particle diameter: 15 nm, manufactured by Nissan Chemical Industries, Ltd.) and each of the addition amount thereof is changed to 20 parts and 10 parts. The area pressure at the contact portion between the image bearing member and the cleaning blade is changed to 1.5 MPa and the evaluation is made. The results are shown in Table 1.

Comparative Examples 27 to 30

Toners of Comparative Examples 27 to 30 are prepared in the same manner as in Example 1 except that the modified laminar inorganic mineral (CLAYTONE APA, manufactured by Southern Clay Inc.) is changed to ORGANO SILLICA SOL (MEK-ST-UP, solid portion: 20%, average primary particle diameter: 15 nm, manufactured by Nissan Chemical Industries, Ltd.) and each of the addition amount thereof is changed to 25 parts, 20 parts, 15 parts and 10 parts. The area pressure at the contact portion between the image bearing member and the cleaning blade is changed to 1.5 MPa and the evaluation is made. The results are shown in Table 1.

Comparative Examples 31 to 34

Toners of Comparative Examples 31 to 34 are prepared in the same manner as in Example 1 except that the modified laminar inorganic mineral (CLAYTONE APA, manufactured by Southern Clay Inc.) is changed to ORGANO SILLICA SOL (MEK-ST-UP, solid portion: 20%, average primary particle diameter: 15 nm, manufactured by Nissan Chemical Industries, Ltd.) and the addition amount thereof is changed to 5 parts. Each of the area pressure at the contact portion between the image bearing member and the cleaning blade is changed to 2.3, 3.3, 4.2 and 5.5 MPa and the evaluation is made. The results are shown in Table 1.

Comparative Examples 35 to 38

Toners of Comparative Examples 35 to 38 are prepared in the same manner as in Example 1 except that the modified laminar inorganic mineral (CLAYTONE APA, manufactured by Southern Clay Inc.) is changed to ORGANO SILLICA SOL (MEK-ST-UP, solid portion: 20%, average primary particle diameter: 15 nm, manufactured by Nissan Chemical Industries, Ltd.) and the addition amount thereof is changed to 30 parts. Each of the area pressure at the contact portion between the image bearing member and the cleaning blade is changed to 2.3, 3.3, 4.2 and 5.5 Mpa and the evaluation is made. The results are shown in Table 1.

TABLE 1

| | Amount of CLAYTONE APA (% by weight) | SF-1 average | Content ratio of SF-1 of from 100 to 115 | Area pressure (Mpa) | Bad cleaning performance A | Bad cleaning performance B G: less than 0.25 g B: not less than 0.25 g | Amount (g) of toner that has slipped through |
|---|---|---|---|---|---|---|---|
| EX. 1 | 1.7 | 150 | 1.136 | 2.3 | G | G | 0.170 |
| EX. 2 | 1.3 | 141 | 1.754 | 4.2 | G | G | 0.243 |
| EX. 3 | 1.0 | 140 | 1.899 | 5.5 | G | G | 0.153 |
| EX. 4 | 1.3 | 141 | 1.754 | 2.3 | G | G | 0.243 |
| EX. 5 | 1 | 140 | 1.899 | 2.3 | G | G | 0.153 |
| EX. 6 | 0.2 | 136 | 1.922 | 2.3 | G | G | 0.236 |
| EX. 7 | 0.05 | 131 | 1.958 | 2.3 | G | G | 0.248 |
| EX. 8 | 1.7 | 150 | 1.136 | 5.5 | G | G | 0.088 |
| EX. 9 | 1.3 | 141 | 1.754 | 5.5 | G | G | 0.156 |
| EX. 10 | 0.2 | 136 | 1.922 | 5.5 | G | G | 0.178 |
| EX. 11 | 0.05 | 131 | 1.958 | 5.5 | G | G | 0.199 |
| EX. 12 | 0.05 | 131 | 1.958 | 3.3 | G | G | 0.168 |
| EX. 13 | 0.05 | 131 | 1.958 | 4.2 | G | G | 0.198 |
| EX. 14 | 1.7 | 150 | 1.136 | 3.3 | G | G | 0.125 |
| EX. 15 | 1.7 | 150 | 1.136 | 4.2 | G | G | 0.138 |
| CX. 1 | 1.7 | 150 | 1.136 | 1.5 | G | B | 0.326 |
| CX. 2 | 1.3 | 141 | 1.754 | 1.5 | G | B | 0.511 |
| CX. 3 | 1.0 | 140 | 1.899 | 6.5 | G | B | 0.256 |
| CX. 4 | 0 | 142 | 3.226 | 2.3 | G | B | 0.976 |
| CX. 5 | 0 | 142 | 3.226 | 1.5 | G | B | 1.120 |
| CX. 6 | 0 | 136 | 2.679 | 4.2 | G | B | 0.403 |
| CX. 7 | 0 | 136 | 2.679 | 1.5 | G | B | 0.648 |
| CX. 8 | 0 | 132 | 2.315 | 5.5 | G | B | 0.384 |
| CX. 9 | 0 | 132 | 2.315 | 6.5 | G | B | 0.711 |
| CX. 10 | 1 | 140 | 1.899 | 1.5 | G | B | 0.346 |
| CX. 11 | 0.2 | 136 | 1.922 | 1.5 | G | B | 0.648 |
| CX. 12 | 0.05 | 131 | 1.958 | 1.5 | G | B | 0.48 |
| CX. 13 | 1.7 | 150 | 1.136 | 6.5 | G | B | 0.253 |
| CX. 14 | 1.3 | 141 | 1.754 | 6.5 | G | B | 0.277 |
| CX. 15 | 1 | 140 | 1.899 | 6.5 | G | B | 0.32 |
| CX. 16 | 0.2 | 136 | 1.922 | 6.5 | G | B | 0.469 |
| CX. 17 | 0.02 | 128 | 2.216 | 2.3 | G | B | 0.865 |
| CX. 18 | 0.02 | 128 | 2.216 | 3.3 | G | B | 0.592 |
| CX. 19 | 0.02 | 128 | 2.216 | 4.2 | G | B | 0.441 |

TABLE 1-continued

| | Amount of CLAYTONE APA (% by weight) | SF-1 average | Content ratio of SF-1 of from 100 to 115 | Area pressure (Mpa) | Bad cleaning performance A | Bad cleaning performance B G: less than 0.25 g B: not less than 0.25 g | Amount (g) of toner that has slipped through |
|---|---|---|---|---|---|---|---|
| CX. 20 | 0.02 | 128 | 2.216 | 5.5 | G | B | 0.328 |
| CX. 21 | 2 | 162 | 0.024 | 2.3 | G | B | 0.621 |
| CX. 22 | 2 | 162 | 0.024 | 3.3 | G | B | 0.516 |
| CX. 23 | 2 | 162 | 0.024 | 4.2 | G | B | 0.487 |
| CX. 24 | 2 | 162 | 0.024 | 5.5 | G | B | 0.485 |
| CX. 25 | 0 | 140 | 1.899 | 1.5 | G | B | 0.346 |
| CX. 26 | 0 | 131 | 1.958 | 1.5 | G | B | 0.48 |
| CX. 27 | 0 | 150 | 1.136 | 6.5 | G | B | 0.253 |
| CX. 28 | 0 | 141 | 1.754 | 6.5 | G | B | 0.277 |
| CX. 29 | 0 | 140 | 1.899 | 6.5 | G | B | 0.32 |
| CX. 30 | 0 | 136 | 1.922 | 6.5 | G | B | 0.469 |
| CX. 31 | 0 | 128 | 2.216 | 2.3 | G | B | 0.865 |
| CX. 31 | 0 | 128 | 2.216 | 3.3 | G | B | 0.592 |
| CX. 33 | 0 | 128 | 2.216 | 4.2 | G | B | 0.441 |
| CX. 34 | 0 | 128 | 2.216 | 5.5 | G | B | 0.328 |
| CX. 35 | 0 | 162 | 0.024 | 2.3 | G | B | 0.621 |
| CX. 36 | 0 | 162 | 0.024 | 3.3 | G | B | 0.516 |
| CX. 37 | 0 | 162 | 0.024 | 4.2 | G | B | 0.487 |
| CX. 38 | 0 | 162 | 0.024 | 5.5 | G | B | 0.485 |

Ex. represents Example
CX. represents Comparative Example
G: Good
B: Bad

As seen in Table 1, it is obvious that the toner for use in the present invention containing a modified laminar inorganic mineral is excellent in cleaning performance.

It is considered that the movement at the nip portion of an image bearing member and a cleaning blade can be secured by using the material described in the present invention.

This document claims priority and contains subject matter related to Japanese Patent Application No. 2006-252000, Sep. 19, 2006, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member configured to bear a latent electrostatic image;

a charging member configured to charge a surface of the image bearing member;

an irradiation member configured to irradiate the image bearing member to write the latent electrostatic image;

a development member configured to develop the latent electrostatic image with a toner to form a visualized image;

a transfer device configured to transfer the visualized image directly or via an intermediate transfer body to a recording medium;

a fixing device configured to fix the transferred image transferred on the recording medium; and a cleaning device configured to remove residual toner remaining on the image bearing member, wherein the cleaning device comprises an elastic member having a blade forming a front end which is in contact with the image bearing member at a pressure of from 2 to 6 Mpa; wherein the toner is granulated in an aqueous phase and comprises a laminar inorganic mineral having ions between layers; at least part of the laminar inorganic mineral is modified by an organic ion; and wherein an average of a form factor SF-1 of the toner is from 130 to 160.

2. The image forming apparatus according to claim 1, wherein a number of particles of the toner having a form factor SF-1 of from 100 to 115 is not greater than 2% by number based on a total number of toner particles.

3. The image forming apparatus according to claim 1, wherein the toner is manufactured by dissolving or dispersing in an organic solvent a toner composition comprising a binder resin, a prepolymer comprising a modified polyester-based resin, a compound which elongates or cross-links with the prepolymer, a coloring agent, a releasing agent, and the laminar inorganic mineral having ions between layers, wherein part of the laminar inorganic mineral is modified by an organic ion, emulsifying or dispersing the solution or the liquid dispersion in an aqueous medium to conduct at least one of a cross-linking reaction and an elongation reaction, and removing the solvent from the resultant liquid dispersion.

4. The image forming apparatus according to claim 3, wherein the laminar inorganic mineral is contained in the toner composition in an amount of from 0.025 to 5% by weight based on a total weight of the toner composition.

5. The image forming apparatus according to claim 1, wherein the toner has a volume average particle diameter (Dv) of from 3 to 8 μm and a ratio (Dv/Dn) of the volume average particle diameter (Dv) to a number average particle diameter (Dn) is from 1.00 to 1.30.

6. The image forming apparatus according to claim 1, wherein the toner comprises particles having a particle diameter of not greater than 2 μm in an amount of from 1 to 10% by number based on a total number of toner particles.

7. The image forming apparatus according to claim 1, wherein the toner has a spherical form.

8. The image forming apparatus according to claim 1, wherein particulates having a primary average particle diameter of from 50 to 500 nm and a bulk density of not less than 0.3 g/cm$^2$ are externally added to a surface of a mother toner particle of the toner.

9. A process cartridge comprising:

an image bearing member; and at least one of a charging device, a development device and a cleaning device, wherein the image bearing member and the at least one of a charging device, a development device and a cleaning device are integrated into one unit and the process cartridge is detachably attached to a main body of the image forming apparatus of claim 1.

* * * * *